US010745910B2

(12) United States Patent
Strickland

(10) Patent No.: US 10,745,910 B2
(45) Date of Patent: Aug. 18, 2020

(54) WET SEAL SYSTEM

(71) Applicant: INVENT TO BUILD INC., Richmond Hill (CA)

(72) Inventor: Michael R. Strickland, Richmond Hill (CA)

(73) Assignee: INVENT TO BUILD INC., Richmond Hill, Ontario (CA)

( * ) Notice: Subject to any disclaimer, the term of this patent is extended or adjusted under 35 U.S.C. 154(b) by 0 days.

(21) Appl. No.: 16/128,200

(22) Filed: Sep. 11, 2018

(65) Prior Publication Data

US 2019/0078324 A1 Mar. 14, 2019

Related U.S. Application Data

(60) Provisional application No. 62/714,022, filed on Aug. 2, 2018, provisional application No. 62/648,754, filed on Mar. 27, 2018, provisional application No. 62/556,861, filed on Sep. 11, 2017.

(51) Int. Cl.
*E04B 1/68* (2006.01)
*E04B 2/92* (2006.01)

(52) U.S. Cl.
CPC ..... *E04B 1/6813* (2013.01); *E04B 1/6815* (2013.01); *E04B 1/6816* (2013.01); *E04B 2/92* (2013.01)

(58) Field of Classification Search
CPC ..... E04B 1/6813; E04B 2/92; E04B 1/6816; E04B 1/6815
USPC ..... 52/395
See application file for complete search history.

(56) References Cited

U.S. PATENT DOCUMENTS

| | | | | |
|---|---|---|---|---|
| 2,680,370 A | | 6/1954 | Spaight | |
| 3,099,110 A | | 7/1963 | Spaight | |
| 3,205,629 A | | 9/1965 | Rumley et al. | |
| 3,447,430 A | * | 6/1969 | Gausepohl | E04B 1/6804 404/69 |
| 3,527,009 A | * | 9/1970 | Nyquist | E04B 1/6815 52/396.05 |
| 3,788,021 A | | 1/1974 | Husler | |
| 4,110,948 A | | 9/1978 | Maier, Jr. | |
| 4,111,584 A | * | 9/1978 | Fyfe | E01D 19/06 404/69 |

(Continued)

FOREIGN PATENT DOCUMENTS

| | | | | |
|---|---|---|---|---|
| CA | 2166593 A1 | | 7/1997 | |
| CH | 511343 A | * | 8/1971 | E04B 1/6815 |

(Continued)

OTHER PUBLICATIONS

International Search Report for PCT/CA2018/051118, dated Jan. 24, 2019.

*Primary Examiner* — Jeanette E Chapman
(74) *Attorney, Agent, or Firm* — Hill & Schumacher

(57) ABSTRACT

This disclosure discloses a wet seal system for use with a wall comprised of exterior insulated wall panels wherein the wet seal system is used with caulking to seal the joints between the exterior insulated wall panels. The wet seal system generally comprises a vertical seal, a horizontal seal, an upper wet core plug and a lower wet core plug, wherein each of the vertical seal, horizontal seal, upper wet core plug and lower wet core plug is configured to compress such that the wet seal system can seal walls with large construction tolerances.

6 Claims, 24 Drawing Sheets

(56) References Cited

U.S. PATENT DOCUMENTS

| | | | | |
|---|---|---|---|---|
| 4,773,791 | A * | 9/1988 | Hartkorn | E01D 19/06 404/56 |
| 4,843,791 | A * | 7/1989 | Michlovic | E04B 2/965 52/235 |
| 4,854,095 | A * | 8/1989 | Michlovic | E04B 2/88 52/235 |
| 4,884,381 | A | 12/1989 | Betti | |
| 5,076,034 | A * | 12/1991 | Bandy | E04B 2/967 52/204.591 |
| 5,092,095 | A | 3/1992 | Zadok et al. | |
| 5,129,754 | A | 7/1992 | Brower | |
| 5,212,922 | A * | 5/1993 | Werner | E04B 2/967 52/208 |
| 5,347,778 | A | 9/1994 | Bray | |
| 5,469,683 | A | 11/1995 | McKenna et al. | |
| 6,253,514 | B1 * | 7/2001 | Jobe | E04B 1/6801 52/395 |
| 6,484,465 | B2 * | 11/2002 | Higgins | E04F 13/081 52/235 |
| 8,132,380 | B2 | 3/2012 | Wilkes, Jr. | |
| 8,887,463 | B2 * | 11/2014 | Derrigan | E02D 17/10 404/25 |
| 9,322,163 | B1 * | 4/2016 | Hensley | E04B 1/6813 |
| 9,464,432 | B2 | 10/2016 | Lang et al. | |
| 10,385,564 | B2 * | 8/2019 | Fisher | E04B 1/6807 |
| 2005/0066600 | A1 * | 3/2005 | Moulton | E01D 19/06 52/393 |
| 2019/0078323 | A1 * | 3/2019 | Strickland | E04F 13/0891 |
| 2019/0169836 | A1 * | 6/2019 | Fisher | E04B 5/36 |

FOREIGN PATENT DOCUMENTS

| | | | | |
|---|---|---|---|---|
| DE | 1805484 | A1 * | 5/1969 | E04B 2/92 |
| DE | 202004017823 | U1 | 3/2006 | |
| FR | 3017684 | A1 | 2/2014 | |
| GB | 249165 | | 1/1927 | |
| JP | 2015163762 | A | 9/2015 | |
| KR | 200420845 | Y1 | 7/2006 | |
| WO | 9913174 | | 3/1999 | |
| WO | 2007048188 | A1 | 5/2007 | |
| WO | 2017017053 | A1 | 2/2017 | |

* cited by examiner

WET SEAL SYSTEM

FIELD OF THE DISCLOSURE

This disclosure relates to seal assemblies and in particular a wet seal system for use with light weight exterior wall panels that include panel joint seals.

BACKGROUND

There are two commonly used light weight exterior wall panel systems used in the construction industry today, namely aluminium framed curtain walls and exterior insulated finish system (EIFS).

Aluminium framed curtain wall panels are the most common method for providing exterior walls on multi-story buildings. They have extruded dry-seal systems that protect the building against air and water infiltration and provide superior longevity. A dry seal system can be designed to incorporate the rain screen principle, so the joint can be pressure equalized to help keep moisture away from the seals. The panels can incorporate windows, stone finish or a metal finish. The downside of unitized curtain wall panels is that they perform quite poorly regarding thermal protection of the building.

Exterior insulated panels (sometimes referred to as EIFS) are becoming more commonly used today for multi-story curtain wall construction. When these panels are properly designed and installed, they provide optimum thermal protection for the building. Unfortunately, this type of construction typically requires the joints between the panels to be caulked after the panels are erected. Caulking is what is known as a wet-seal system, they are subject to human error and inclement weather. Caulked joints do not provide the same level of quality and endurance as dry-seal systems and incorporating the rain screen principle is difficult to do with caulked joints. Unfortunately, caulking the joints needs to be done using scaffolding or swing stages located on the outside of the building, this can be costly and makes the work more dangerous to do. The latter is expensive and adds time required to complete the installation. Caulking is also problematic when the proximity of the adjacent building is too close to the new wall to allow access. Additionally, caulking requires skilled labourers and detailed inspection to ensure that the caulked joints are sealed properly.

Dry seal systems for EIFS exist, however they are only capable of sealing relatively small gaps between wall panels with small construction tolerances. This is a problem because aluminium framed curtain wall panels and EIFS typically have large construction tolerances. This means that one cannot use a rigid dry seal because the gap between two panels may vary along the shared length of the panels.

Therefore, it would be advantageous to provide a wet seal system which is easy for unskilled labourers to install.

SUMMARY

The present disclosure relates to a wet seal system for use with vertically adjacent and horizontally adjacent exterior insulated wall panels. The wet seal system includes a vertical seal, a horizontal seal, an upper plug and a lower plug. The vertical seal has a top and a bottom positioned between the horizontally adjacent exterior insulated wall panels. The horizontal seal has a top and a base positioned between the vertically adjacent exterior insulated wall panels. The upper plug assembly is positioned between the top of the horizontal seal and the bottom of the vertical seal. The lower plug assembly is positioned between the bottom of the horizontal seal and the top of the vertical seal. The vertical seal, the upper plug assembly and the lower plug assembly are configured to be filled with caulking such that a wet seal is formed between the horizontally adjacent exterior insulated wall panels. The wet seal system is configured to seal at least a 3-way joint between at least three exterior insulated wall panels.

The wet seal system may be configured to seal a 4-way joint between four exterior insulated wall panels. The vertical seal of the 4-way joint is configured to receive caulking.

The vertical seal may include a caulking inspection hole such that when the vertical seal is filled with caulking, caulking exits the caulking inspection hole.

The vertical seal may be a generally tubular member having a caulking cavity configured to receive caulking.

The vertical seal may include a pair of opposed spaced apart sealing sides, a deformable exterior side connected between the pair of sealing sides, a deformable interior side connected between the sealing sides and spaced from the deformable exterior side and the sealing sides, the deformable exterior side and the deformable interior side defining the caulking cavity.

The vertical seal may include a vertical plug configured to be placed in the caulking cavity adjacent the deformable exterior side. The deformable exterior side, the vertical plug and deformable interior side are configured such that the caulking cavity has a generally hourglass shaped cross section. The hourglass shaped cross section has a width to throat ratio of 2:1. The deformable interior side may have at least one caulking hole for receiving the caulking.

The vertical seal may include a caulking inspection hole such that when the vertical seal is filled with caulking, caulking exits the caulking inspection hole.

The deformable exterior side may have a triangular shape and the deformable interior side has a trapezoidal shape.

The deformable exterior side may have a round shape and the deformable interior side has a round shape.

The vertical seal further may include a rain screen.

The upper plug assembly and the lower plug assembly each may include a rain screen.

A vertical seal is for use with vertically adjacent exterior insulated wall panels. The vertical seal includes a pair of opposed spaced apart sealing sides, a deformable exterior side and a deformable interior side. The deformable exterior side is connected between the pair of sealing sides. The deformable interior side is connected between the sealing sides and spaced from the deformable exterior side and the sealing sides. The deformable exterior side and the deformable interior side define a caulking cavity.

The vertical seal may include a vertical plug configured to be placed in the caulking cavity adjacent the deformable exterior side and the deformable exterior side, and the plug and deformable interior side are configured such that the caulking cavity has a generally hourglass shaped cross section. The hourglass shaped cross section has a width to throat ratio of 2:1.

The vertical plug may be an elongate foam element.

The deformable interior side may have at least one caulking hole for receiving the caulking.

The vertical seal further may include a caulking inspection hole such that when the vertical seal is filled with caulking, caulking exits the caulking inspection hole.

The vertical seal may include a rain screen.

The deformable exterior side may have a triangular shape and the deformable interior side may have a trapezoidal shape. Alternatively, the deformable exterior side may have a round shape and the deformable interior side may have a round shape.

A horizontal seal is for use with horizontally adjacent exterior insulated wall panels. The horizontal seal includes a base, a top, an exterior wall and an interior wall. The base has at least a pair of spaced apart base feet extending downwardly therefrom. The top is spaced apart from the base and has at least a pair of spaced apart top feet extending upwardly therefrom. The exterior wall extends between the base and the top and the exterior wall has a bend therein. The interior wall extends between the base and the top and the interior wall has a bend therein. The base, the top, the exterior wall and the interior wall define a tubular member. The bend in the exterior wall and the bend in the interior wall facilitates movement of the base relative to the top.

The base feet may be aligned with exterior wall and the interior wall.

The top feet may be aligned with the exterior wall and the interior wall.

The horizontal seal may include a chamber wall positioned between the exterior wall and the interior wall and extending between the base and the top, thereby forming two chambers.

The horizontal seal may include a hole formed in the exterior wall to provide pressure equalization.

The horizontal seal may include a plurality of chamber walls positioned between the exterior wall and the interior wall and extending between the base and the top, thereby forming a plurality of chambers.

The horizontal seal may include a front extension.

The horizontal seal may include a hole formed in the exterior wall to provide pressure equalization.

A method for splicing two horizontal seals comprising the steps of: positioning a first horizontal seal such that an end of the first horizontal seal is adjacent to an end of a second horizontal seal and there is a gap between the end of the first horizontal seal and the end of the second horizontal seal; cutting a section of a top of the first horizontal seal and cutting a section of a top of the second horizontal seal such that the sections are adjacent and form a splice cavity; inserting horizontal seal stoppers into the first horizontal seal and inserting horizontal seal stoppers into the second horizontal seal such that the caulking cannot flow from the splice cavity through the first horizontal seal or the second horizontal seal; positioning an exterior formation block in contact with an exterior wall of the first horizontal seal and an exterior wall of the second horizontal seal, and further positioning an interior formation block in contact with an interior wall of the first horizontal seal and an interior wall of the second horizontal seal such that caulking cannot flow through the gap between the first horizontal seal and the second horizontal seal; applying a volume of caulking to a bottom of the splice cavity such that the volume of caulking forms a caulking layer; placing a splice core on top of the caulking layer; filling the splice cavity with caulking such that a continuous volume of caulking is formed from the bottom of the splice cavity to the top of the first horizontal seal and the top of the second horizontal seal; and removing the exterior formation block and the interior formation block.

A segment of dual-sided foam tape may be fixed to a surface prior to the positioning a first horizontal seal step such that the dual-sided foam tape can fix the first horizontal seal and the second horizontal seal to the surface and align the first horizontal seal and the second horizontal seal. The gap between the first horizontal seal and the second horizontal seal may be ¼".

A method for forming a wet seal system between adjacent insulated wall panels, comprising the steps of: placing an upper plug assembly; placing a vertical seal having two sealing sides on top of the upper plug assembly such that a bottom opening of the vertical seal is in contact with a top side of the upper plug assembly and one of the two sealing sides is in contact with the side edge of a first exterior insulated wall panel; placing a lower plug assembly onto a top opening of the vertical seal such that a bottom side of the lower plug assembly is in contact with the top opening and a side of the lower plug assembly is in contact with the side edge of the first exterior insulated wall panel; positioning a second exterior insulated wall panel such that a bottom edge of the second exterior insulated wall panel contacts the top of the first horizontal seal and a side edge of the second exterior insulated wall panel contacts the upper plug assembly, the vertical seal and the lower plug assembly; and filling a caulking cavity in the upper plug assembly, filling a caulking cavity in the vertical seal and filling a caulking cavity in the lower plug assembly such that a continuous wet seal between the side edge of the first exterior insulated panel and the side edge of the second exterior insulated panel.

The method of forming a wet seal system further may include the steps of: applying caulking to a base of a first horizontal seal and positioning the first horizontal seal such that the base contacts a top edge of a third exterior insulated wall panel; applying caulking to a top of the first horizontal seal; wherein the first exterior insulated wall panel is positioned such that a bottom edge of the first exterior insulated wall panel contacts the top of the first horizontal seal and the upper plug assembly is placed onto the top of the first horizontal seal such that one side of the upper plug assembly contacts a side edge of the first exterior insulated wall panel; and wherein the first horizontal seal, the vertical seal, first exterior insulated wall panel, second exterior insulated wall panel and third insulated wall panel form a 3-way joint.

The method of forming a wet seal system may include repeating the defined steps using a plurality of horizontal seals and a plurality of vertical seals to connect a plurality of horizontally adjacent exterior insulated wall panels and a plurality of vertically adjacent exterior insulated wall panels to form a plurality of joints.

Further features will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

The systems described herein are directed, in general, to systems for forming a combination wet seal/gasket (dry) seal between adjacent exterior insulated wall panels (EIFS) or any other type of exterior panel and more specifically to systems for forming 3-way and 4-way joints between horizontally adjacent and vertically adjacent exterior insulated wall panels, wherein the sealing systems facilitate the formation of wet seals between exterior insulated wall panels with a variety of tolerance issues that need to be dealt with in order to provide an enduring and reliable panel joint system. The disclosed embodiments are merely exemplary, and it should be understood that the system may be embodied in many various and alternative forms.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to wet seal systems.

As used herein, the terms "comprises" and "comprising" are to be construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

Figure 1A:
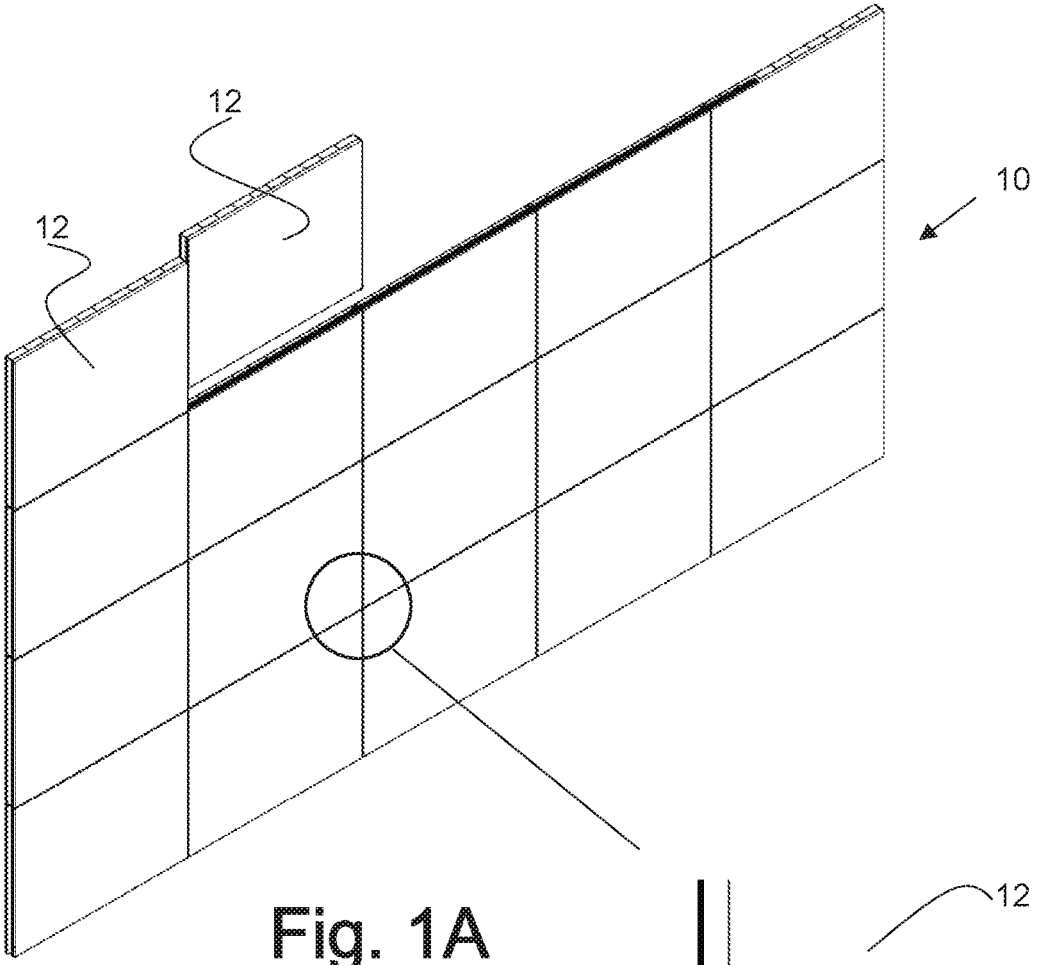
FIG. 1A is a perspective view of an exterior wall system comprised of a plurality of wall panels where vertical and horizontal joints form 4-way joints.
Figure 1B:
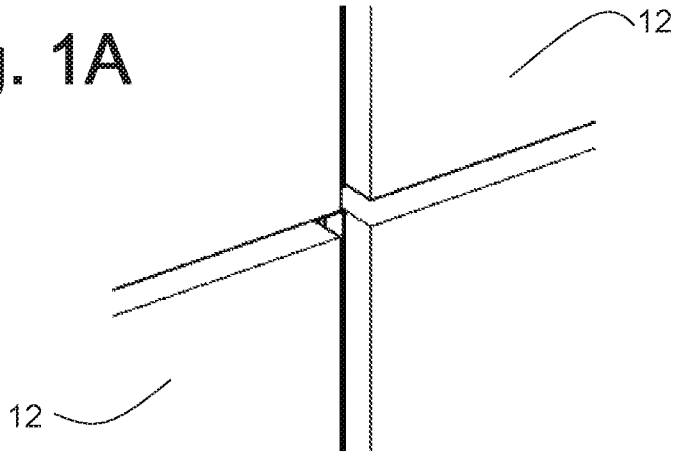
FIG. 1B is an enlarged perspective view of the wall system of FIG. 1A showing a 4-way joint between four wall panels.

FIG. 1A shows an exterior wall system 10 comprised of a plurality of exterior insulated panels 12. FIG. 1B shows a 4-way joint formed by four wall panels 12.

Figure 2A:
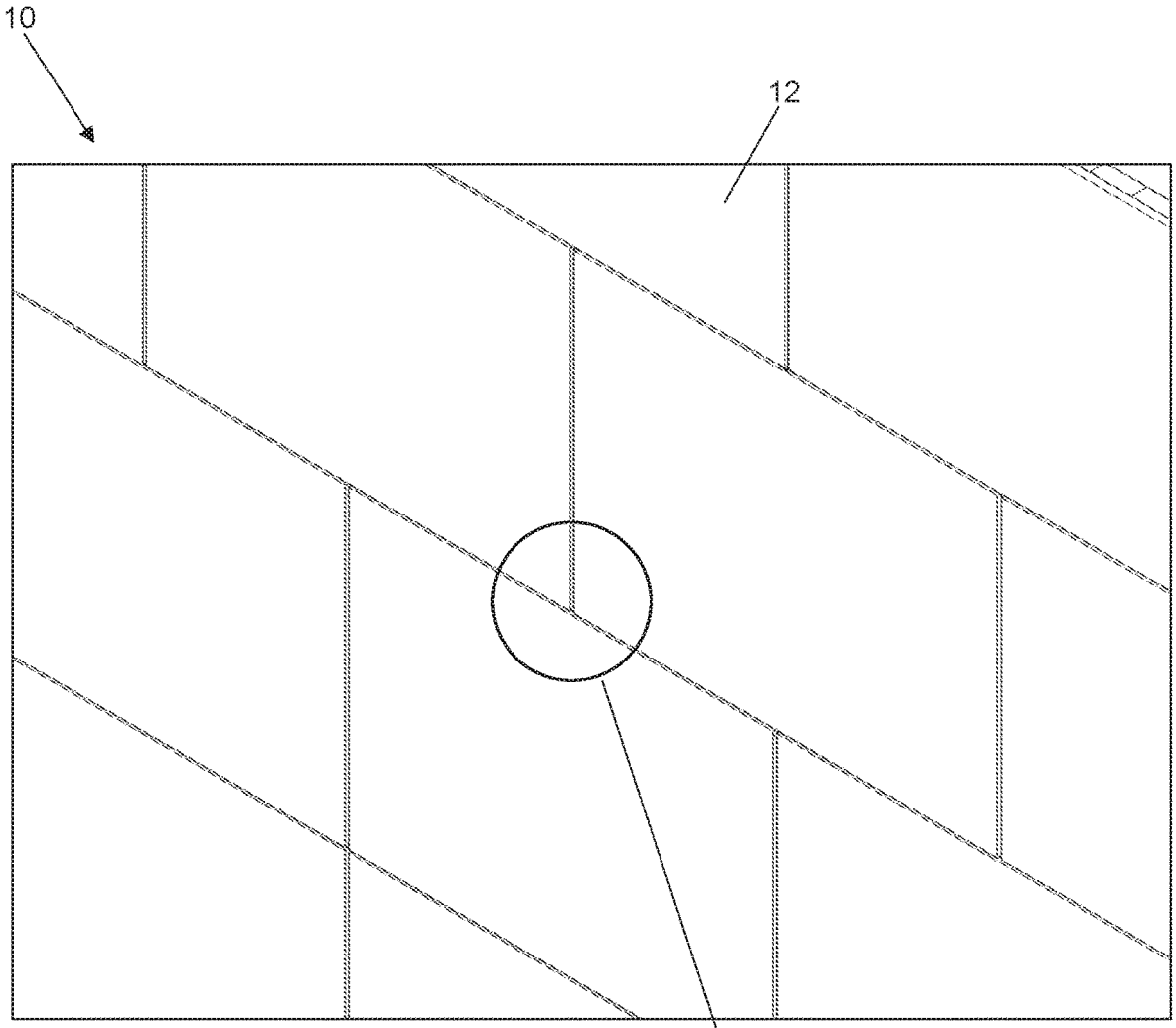
FIG. 2A is a perspective view of an exterior wall system comprised of a plurality of wall panels where vertical and horizontal joints form 3-way joints.
Figure 2B:
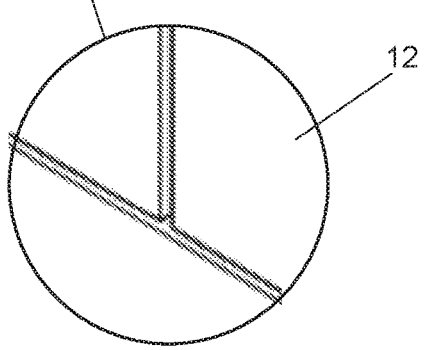
FIG. 2B is an enlarged perspective view of the wall system of FIG. 2A showing a 3-way joint between three wall panels.

FIG. 2A shows the exterior wall system 10 configured to form 3-way joints between exterior insulated panels 12 in a similar pattern to that of a brick wall. FIG. 2B shows a 3-way joint formed by three wall panels 12.

The wet seal system of the present disclosure generally comprises vertical seal, horizontal seal, upper wet core plugs and lower wet core plugs. A segment of vertical seal provides a seal between horizontally adjacent exterior insulated wall panels and a segment of horizontal seal provides a seal between vertically adjacent exterior insulated wall panels. The lower wet core plug is positioned between the bottom of a horizontal seal and the top of a vertical seal. The upper wet core plug is positioned between the top of a horizontal seal and the bottom of a vertical seal. The vertical seal, lower and upper wet core plugs have caulking cavities which provide a continuous cavity for material to flow to create a continuous seal between the vertical seal and the lower and upper wet core plugs, this forms one continuous caulking cavity where caulking is injected into said vertical seals, lower and upper wet core plugs to allow bonding between the caulking and the exterior insulated panels. It will be appreciated by those skilled in the art that the vertical seal extends along the whole length of the panel 12. Similarly, the horizontal seal extends along the whole width of the panel 12.

Figure 3:
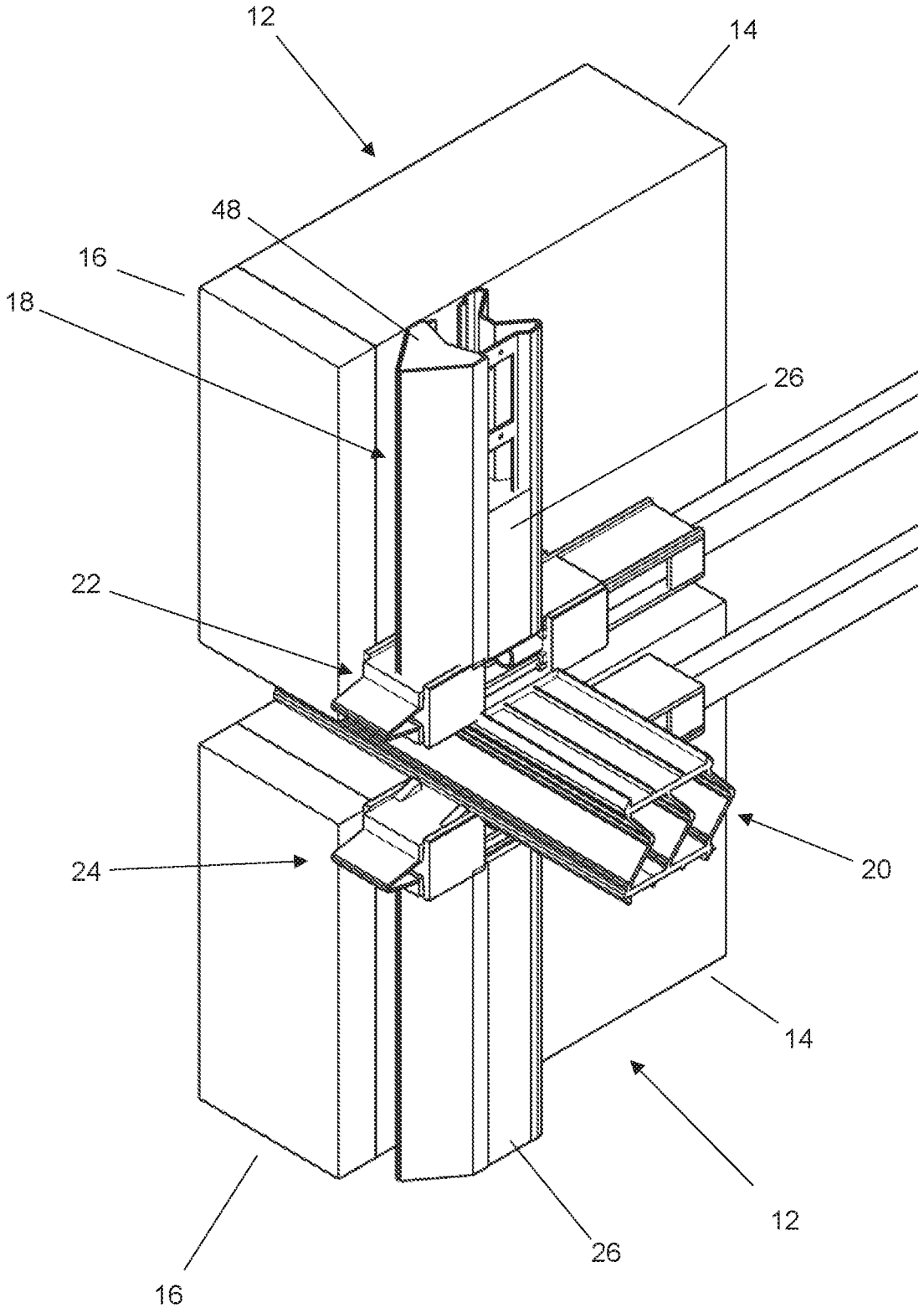
FIG. 3 is a perspective view of a wet sealed 4-way joint which is sealed by an embodiment of the wet seal system comprising two vertical seals, a horizontal seal and an upper wet core plug and a lower wet core plug.

A 4-way joint sealed using an embodiment of the wet seal system of the present disclosure is shown in FIG. 3. The exterior insulated panels 12 typically comprise a light steel frame portion 14 and an exterior insulated portion 16. The 4-way joint is sealed using two vertical seal 18, a segment of horizontal seal 20, an upper wet core plug 22 and a lower wet core plug 24. Where the segment of horizontal seal 20 is positioned between the vertically adjacent wall panels 12 and one segment of vertical seal 18 is between the horizontally adjacent wall panels on top of the horizontal seal 20 and the other segment of vertical seal 18 is between the horizontally adjacent wall panels below the horizontal seal 20. The upper wet core plug 22 is between the horizontal seal 20 and the top vertical seal 18 and the lower wet core plug is between the horizontal seal 20 and the bottom vertical seal 18. The vertical seal 18, upper wet core plug 22 and lower wet core plug 24 are filled with caulking 26.

Figure 4:
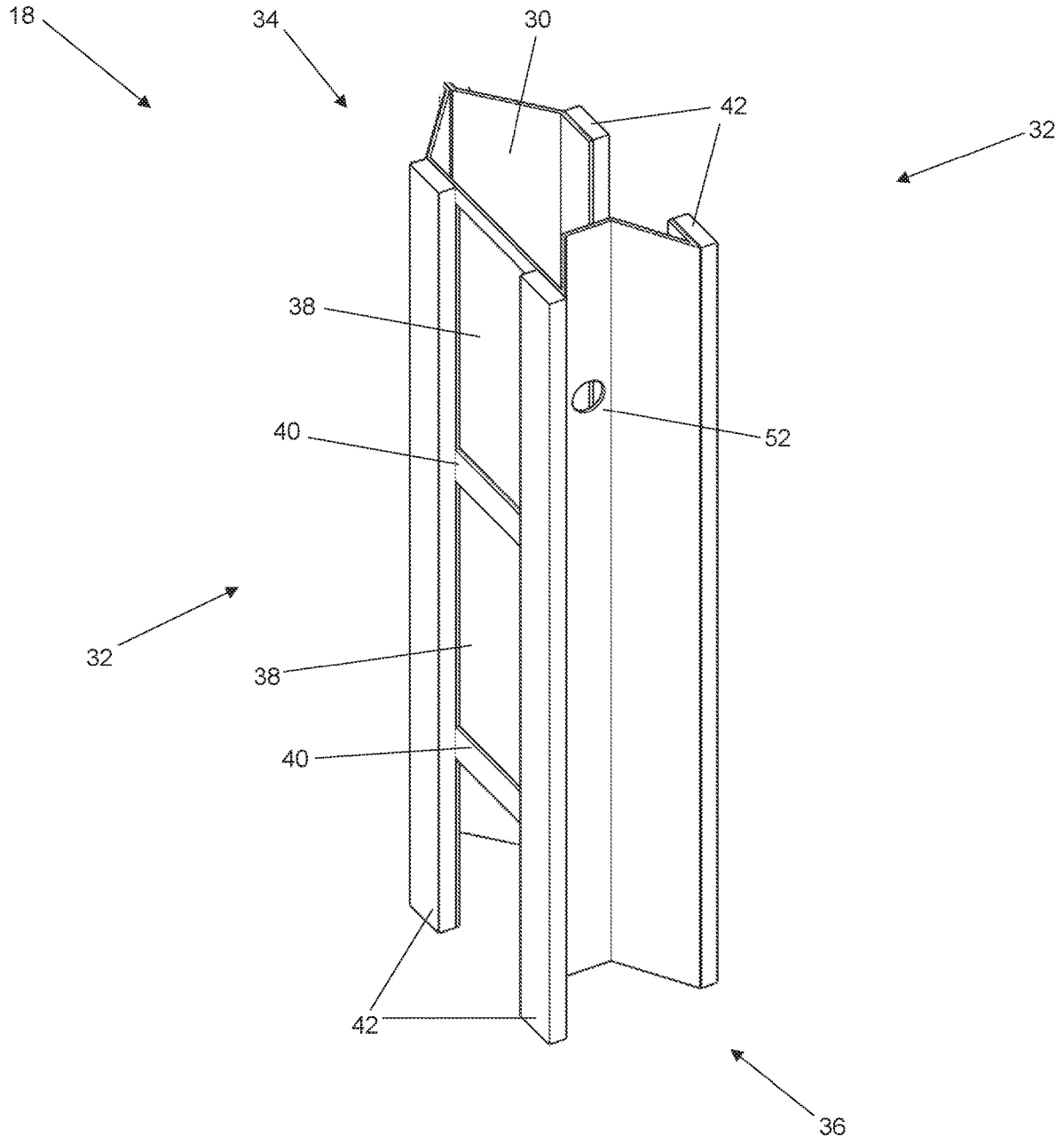
FIG. 4 is a perspective view of the vertical seal of FIG. 3.

The vertical seal 18, shown in detail in FIG. 4, is a tubular member where a caulking cavity 30 is enclosed by a pair of opposed sealing sides 32, a deformable exterior side 34 which joins the exterior facing edges of the sealing sides 32 along the length of the vertical seal 18 and a deformable interior side 36 which joins the interior facing edges of the sealing sides 32 along the length of the vertical seal 18. The exterior side 34 and the interior side 36 are opposed to each other. The sealing sides 32 have caulking holes 38 in between the external side 34 and the internal side 36 which allow for the flow of wet caulking between the caulking cavity 30 and the space external to the sealing sides 32. The caulking holes 38 are separated by web segments 40. The vertical seal 18 further includes spacers 42 on the sealing sides 32 where each sealing side 32 has one spacer 42 on either side of the caulking holes 38 along its length. The spacers 42 separates the web segments 40 from the edge of the adjacent wall panel such that there is a sealing space 44 (shown in FIG. 5A) between the sealing side 32 and the edge of the wall panel which is confined by the spacers 42. In the embodiment of the vertical seal of FIG. 4 the spacers 42 are thermal break strips which are separate components from the vertical seal 18. In a more preferred embodiment the thermal break strips have a thickness of approximately ⅛" and have adhesive on one side such that the thermal break strips can be easily attached to the vertical seal 18 on site. In an alternate embodiment of the vertical seal, the spacers are incorporated into the vertical seal.

The top and bottom ends of the vertical seal 18 each have a plug which decreases the cross-sectional area of the caulking cavity 30 so that caulking can flow between the vertical seal 18 and the lower 22 and upper 24 wet core plugs without leaking. In the embodiment of FIG. 4, the plugs are elongate foam elements 48 (shown in FIG. 13) which are shaped to contour the inside surface of the exterior side 34 and the side of each elongate foam element 48 which does not contact the exterior side 34 is shaped as a convex arc between the edges where the exterior side 34 meets the sealing sides 32. The convex arc on the elongate foam elements 48 ensures that the caulking cures with an hourglass shaped cross section between the two wall panels where the seal is widest along the edges of the wall panels 12 and narrows the farther that the caulking is from the wall panels 12. In a preferred embodiment, the ratio of the width of the hourglass shape to the throat of the hourglass shape is 2:1. The elongate foam elements 48 are used to reduce the amount of wet sealing material needed to seal the joint. One of ordinary skill in the art will appreciate that the open side of the elongate foam elements 48 can have any shape provided that caulking can flow between the caulking cavity 30 and the upper 22 and lower 24 wet core plugs without being able to flow to the outside of the wet seal system. The elongate foam elements 48 are made of a material with compatible properties to the vertical seal 18 such that elongate foam elements 48 when positioned within the vertical seal 18 deform to contour the inside surface of the exterior side 34 when it is deformed. The elongate foam elements 48 may be made of any suitable foam material including EPDM, silicone, etc.

In an alternative embodiment of the elongate foam elements 48, elongate foam elements are one foam plug which has the same length as the vertical seal 18 and, when installed, runs from one end of the vertical seal 18 to the other.

One of ordinary skill in the art will also appreciate that the vertical seal may alternatively have plugs which are incorporated into the vertical seal.

Figure 5A:
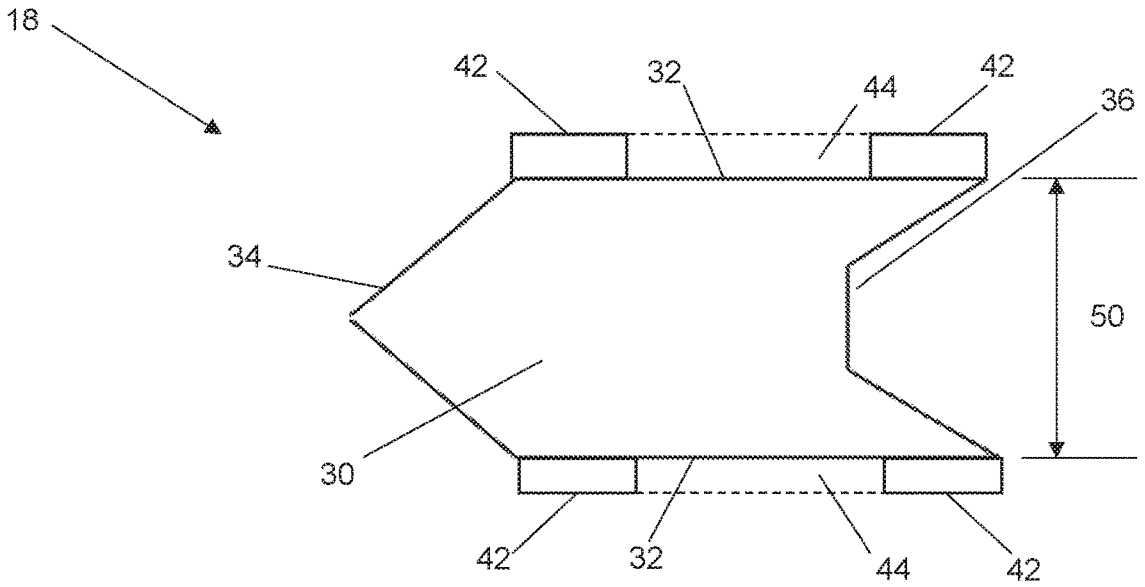
FIG. 5A is a section view of the vertical seal of FIG. 4 in an original shape.
Figure 5B:
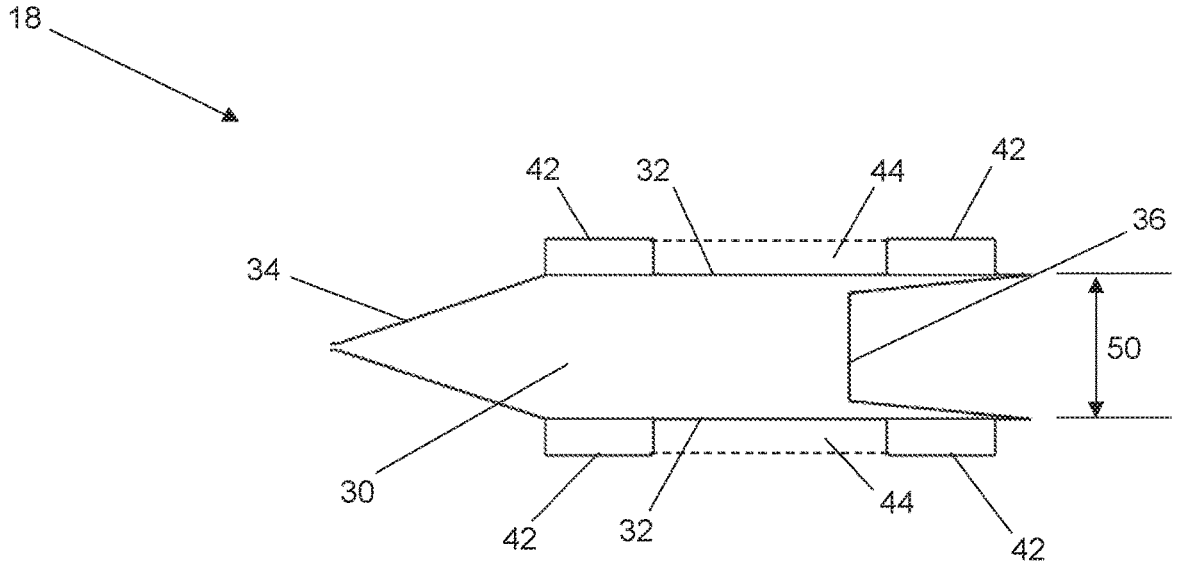
FIG. 5B is a section view of the vertical seal of FIG. 4 in a compressed shape.

The exterior side 34 of the embodiment of the vertical seal 18 shown in FIG. 4 has the shape of an isosceles triangle where the base is the seal width 50, which is the distance between the sealing sides 32. In the same embodiment, the interior side 36 has the shape of a trapezoid where the longer parallel side is the seal width 50. The isosceles shaped exterior side and the trapezoid shaped interior side are shown in FIG. 5A. FIG. 5B shows the vertical seal 18 with a decreased seal width 50 in response to a compressive force where both the height of the exterior side 34 triangle and the height of the interior side 36 trapezoid increase as the seal width 50 decreases. The ability to decrease the seal width 50 means that the vertical seal 18 can be used between horizontally adjacent exterior insulated wall panels where the positions of the panels have large construction tolerances and where the size of the gap between panels varies along the length of the gap and varies between different pairs of horizontally adjacent wall panels. One of ordinary skill in the art will appreciate that the exterior side and the interior side may have any shape such that they can deform to decrease the width of the vertical seal in response to a compressive force being exerted on the sealing sides.

In the embodiment of the vertical seal 18 shown in FIG. 4, the deformable interior side 36 has one caulking injection hole 52. The caulking injection hole 52 is configured such that one can position the nozzle of a caulking gun therethrough and inject caulking into the caulking cavity 30. When the nozzle is positioned within the caulking injection hole 52 a temporary seal is formed such that caulking cannot pass through the caulking injection hole 52 while caulking is being injected into the caulking cavity 30. The caulking injection hole 52 enables one to install a wet seal using the system of the present disclosure from the interior side of the wall. In the embodiment of FIG. 4, the caulking injection hole 52 is located in the flat central portion of the interior side 36 such that the shape of the caulking injection hole 52 does not change when the interior side 36 deforms. The number of caulking injection holes of each vertical seal is determined based on the length of the vertical seal.

One of ordinary skill in the art will appreciate that the vertical seal 18 does not need caulking injections holes 52 and that the caulking cavity 30 may be filled using an alternative method which fills the caulking cavity 30 with caulking 26 such as injecting the caulking through the plug tubes 116.

In a further embodiment of the vertical seal, the vertical seal may have an optional caulking inspection hole with tube 120, which is positioned in the interior side 36 such that caulking may flow through the caulking inspection hole 120 from the caulking cavity 30 when the caulking cavity 30 is full of caulking. The caulking inspection hole 120 enables one to easily inspect a wet seal formed using the system of the present disclosure to confirm that the wet seal has been formed properly. In a preferred embodiment of the vertical seal, the caulking injection holes 52 are used as caulking inspection holes.

In an alternate embodiment of the vertical seal, at least one strip of tape may be fixed to the vertical seal such that each caulking injection hole is covered by tape. When the nozzle of a caulking gun is inserted into a caulking injection hole, the tape is punched out such that caulking can be injected into the caulking cavity.

The vertical seal 18 can be made from any suitable material. In a preferred embodiment the vertical seal is made of cold formed steel. In an alternate preferred embodiment, the vertical seal is made of plastic.

Figure 6:
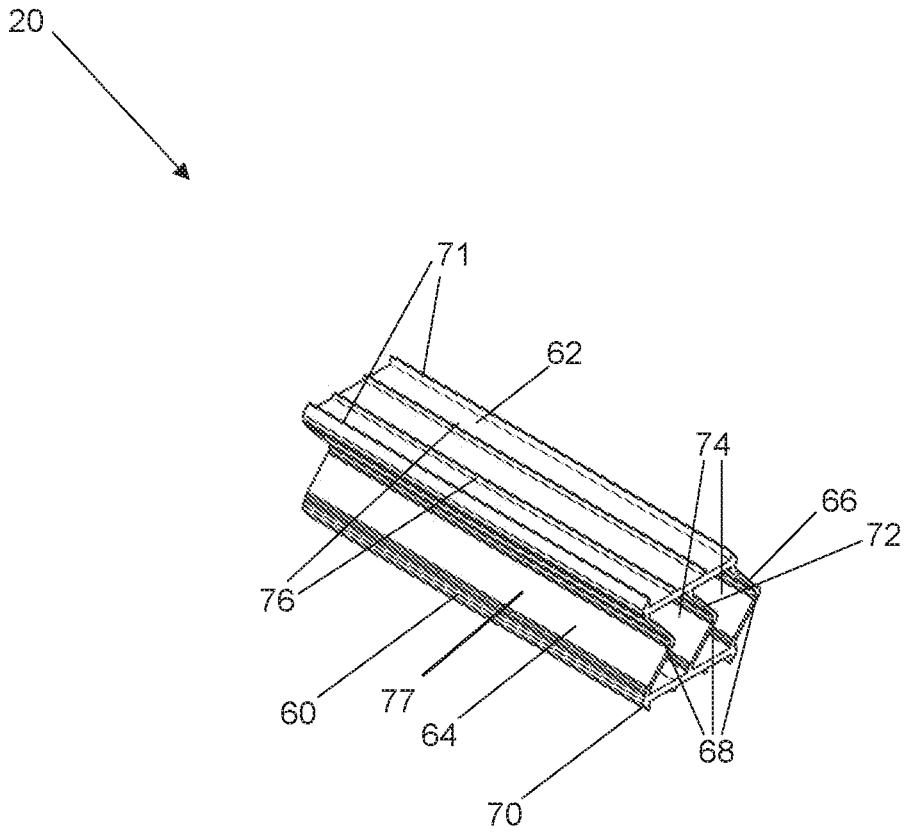
FIG. 6 is a perspective view of the horizontal seal of FIG. 3.

FIG. 6 shows a detailed view of the horizontal seal 20. The horizontal seal 20 is a tubular member having a base 60 and a top 62 with an exterior wall 64 and an interior wall 66 extending therebetween. The base 60 is spaced apart from the top 62. The walls 64 and 66 have bends 68 therein to facilitate the movement of the base 60 relative to the top 62. The base 60 has at least a pair of spaced apart base feet 70 which extend downwardly in line with the walls 64 and 66. The top 62 has at least a pair of spaced apart top feet 71 which extend upwardly in line with the walls 64 and 66. The embodiment of the horizontal seal of FIG. 3 has one chamber wall 72 which extends between the base 60 and the top 62 and also has a bend 68, thus forming two chambers 74. One of ordinary skill in the art will appreciate that the horizontal seal may have any number of chamber walls depending on the width of the horizontal seal. The horizontal seal 20 has feet 70 and 72 on the base 60 and top 62 to aid the application of and the maintenance of the specified caulking depth and to improve the bond between the caulking and the base 60 or top 62. In an alternate embodiment of the horizontal seal, the horizontal seal does not have ridges. Exterior wall 64 may have a hole 77 formed therein to provide pressure equalization.

In the embodiment of the horizontal seal 20 shown in FIG. 6, the horizontal seal 20 is shaped like a thick, hollow chevron where the exterior wall 64 is concave and the interior wall 66 in convex. This shape is preferred because none of the features protrude from the exterior face of the wall which decreases the likelihood that weather will damage the horizontal seal 20.

Figure 7:
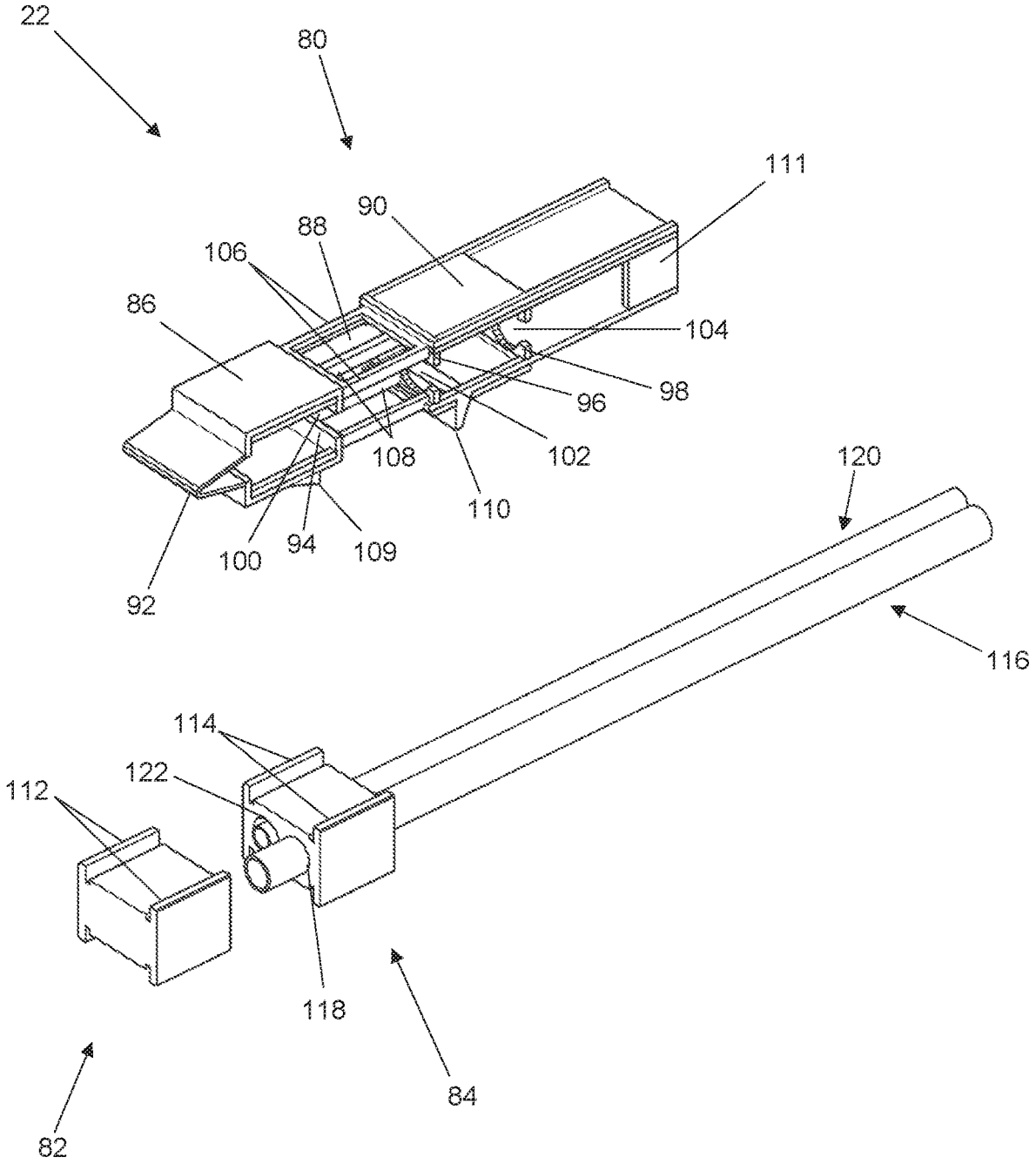
FIG. 7 is an exploded view of the upper wet core plug of FIG. 3.

The horizontal seal 20 is made of resilient deformable material such that the horizontal seal 20 has a memory of its original shape. In a preferred embodiment, the horizontal seal 20 is made of a silicone rubber. In a more preferred embodiment, the silicone rubber displays elastic properties between a temperature range of −50° C. and +80° C. FIG. 7 shows a more detailed view of the upper wet core plug 22 which comprises a plug base 80, an exterior stopper 82 and an interior stopper 84.

The plug base 80 has an exterior stopper section 86, a caulking cavity 88, and an interior stopper section 90. The exterior stopper section 86 has open sides and the top and bottom are closed surfaces such that the exterior stopper 82 extends beyond the sides of the plug base 80 but is contained within the top and bottom. The interior stopper section 90 also has open sides and the top and bottom are also closed surfaces. The exterior side of the exterior stopper section 86 has a hinge 92 which connects the top and bottom portions of the plug base 80 such that the plug base can be opened and the exterior stopper 82 can be placed within the exterior stopper section 86 and the interior stopper 84 can be placed within the interior stopper section 90. The exterior stopper section 86 has a wall 94 which separates it from the caulking cavity 88, the interior stopper section 90 has a wall 96 which separates it from the caulking cavity 88 and the interior stopper section 90 also has an interior wall 98. Each of the walls 94, 96 and 98 have a slot 100, 102 and 104 respectively which separates the top and bottom portions of the plug base 80. The caulking cavity 88 is open on the four sides between the exterior stopper section 86 and the interior stopper section 90. The caulking cavity 88 has four thin beams 106 which connect the wall 94 to the wall 96 and has two thick beams 108 which connect the wall 94 to the wall 96. One of ordinary skill in the art will appreciate that the plug base 80 may have any number of thin beams or thick beams such that the exterior stopper section 86 cannot move relative to the interior stopper section 90.

The plug base 80 has an exterior locator stub 109 and an interior locator stub 110 where the exterior locator stub 109 is located on the bottom of the exterior stopper section 86 and the interior locator stub 110 is located on the bottom of the interior stopper section 90. The exterior 109 and interior 110 locator stubs are spaced apart by the same distance that separates the feet 70 and 71 of the horizontal seal 20. Thus, the upper wet core plug 22 can be positioned on the top 62 of the horizontal seal 20 such that the exterior 109 and interior 110 locator stubs prevent the upper wet core plug 22 from moving relative to the horizontal seal 20. In the embodiment of the upper wet core plug of FIG. 3, the interior locator stub 110 is longer than the exterior locator stub 109. This makes the upper wet core plug 22 easier to install from the interior side of a wall because the exterior locator stub 109 can pass over feet 70 and 71 of the horizontal seal 20 and the longer interior locator stub 110 stops the upper wet core plug 22 when it is fully inserted. When the upper wet core plug 22 is fully inserted, the exterior locator stub 109 prevents the upper wet core plug 22 from moving back relative to the horizontal seal 20.

The plug base 80 also has a handle 111 which extends from the interior stopper section 90 such that one can insert the upper wet core plug 22 between two horizontally adjacent exterior insulated panels. One of ordinary skill in the art will appreciate that the upper wet core plug 22 can be inserted with a separate tool or by hand.

In a preferred embodiment, the plug base 80 is produced using injection moulding. In a further preferred embodiment the plug base is produced using plastic injection moulding where the plug base is made of a plastic. In a further preferred embodiment, the plastic is PVC.

The exterior stopper 82 is shaped such that it fits within the exterior stopper section 86 and has two lateral sealing sections 112 where one lateral sealing section 112 extends through each of the open sides of the exterior stopper section 86.

The interior stopper 84 is shaped such that it fits within the interior stopper section 90 and has two lateral sealing sections 114 where one lateral sealing section 114 extends through each of the open sides of the interior sealing section 90.

The exterior stopper 82 and the interior stopper 84 are both made of an elastic material such that the stoppers 82 and 84 decrease in height when a compressive force is applied to the top and bottom of the plug base 80. Additionally, the elastic material enables the lateral sealing sections 112 and 114 to decrease in width when a compressive force is applied to the sides of the plug base 80. In a preferred embodiment, the exterior stopper 82 and the interior stopper 84 are made of EPDM or other foam type materials.

In the embodiment of the upper wet core plug of FIG. 3, the upper wet core plug 22 further includes a caulking injection tube 116. In this embodiment the interior stopper 84 has a caulking injection tube channel 118 which is configured for the caulking injection tube 116 to be inserted through and form an interference fit such that caulking can be injected into the caulking cavity 88. In this embodiment the walls 102 and 104 are shaped to restrain the interior stopper 84 and not pinch the caulking injection tube 116. In an alternate embodiment of the wet seal system, the upper wet core plug is not configured to have a caulking injection tube.

In the embodiment of the upper wet core plug of FIG. 3, the upper wet core plug has a caulking inspection tube 120. In this embodiment the interior stopper 84 has a caulking inspection tube channel 122 which is configured for the caulking inspection tube to be inserted through and form an interference fit such that caulking can flow from the caulking cavity 88 through the caulking inspection tube 120 where one can inspect whether the wet seal system has been filled with caulking. In an alternate embodiment of the wet seal system, the upper wet core plug is not configured to have a caulking inspection tube. In a preferred embodiment, the caulking inspection tube 120 has a smaller diameter than that of the caulking injection tube 116.

Figure 8:
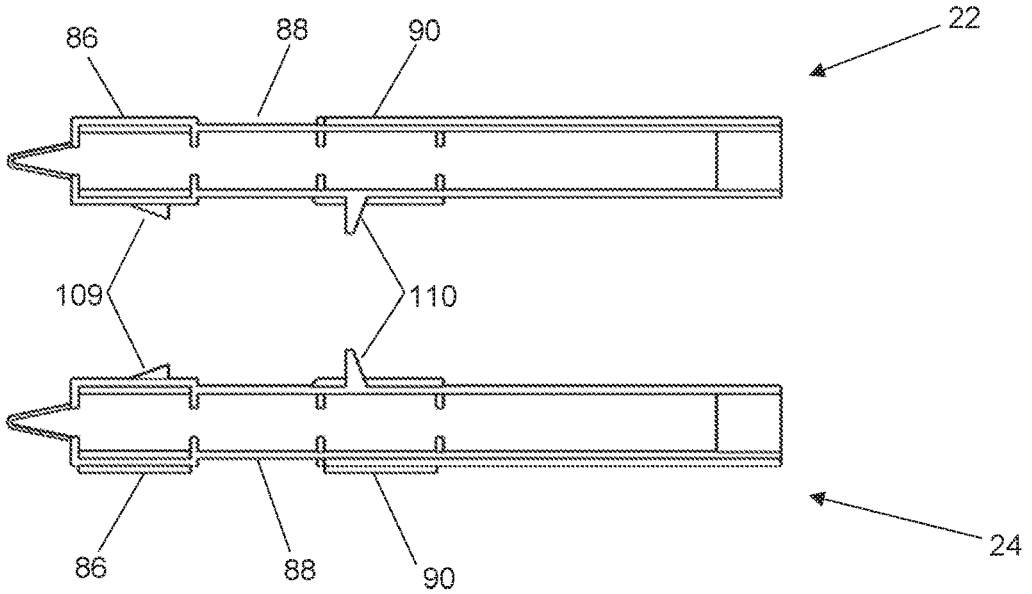
FIG. 8 is a side view of the upper wet core plug of FIG. 3 and the lower wet core plug of FIG. 3.

The lower wet core plug 24 is the same as the upper wet core plug 22, as shown in FIG. 8, except that it is configured to be positioned under the base 60 of the horizontal seal 20. Therefore, the base 80 of the lower wet core plug 20 also has two locator stubs but the exterior locator stub 109 is located on the top of the exterior stopper section 86 and the interior locator stub 110 is located on the top of the interior stopper section 90.

Figure 9:
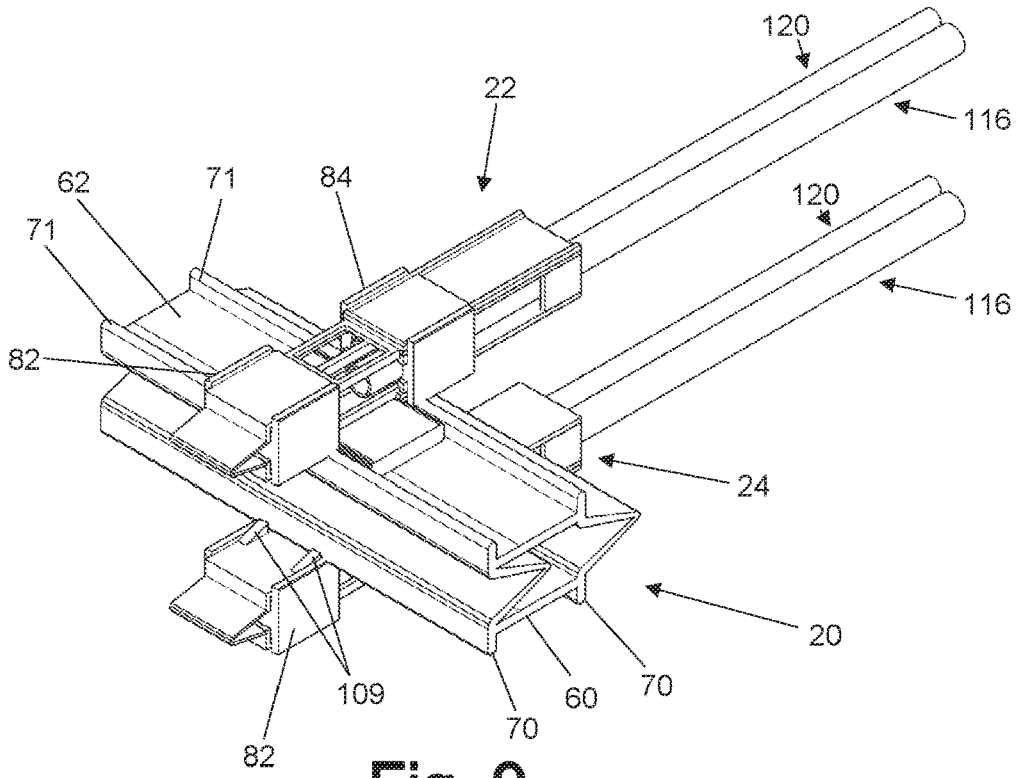
FIG. 9 is a perspective view of the horizontal seal of FIG. 3, the upper wet core plug of FIG. 3 and the lower wet core plug of FIG. 3 in an installed state.
Figure 10:
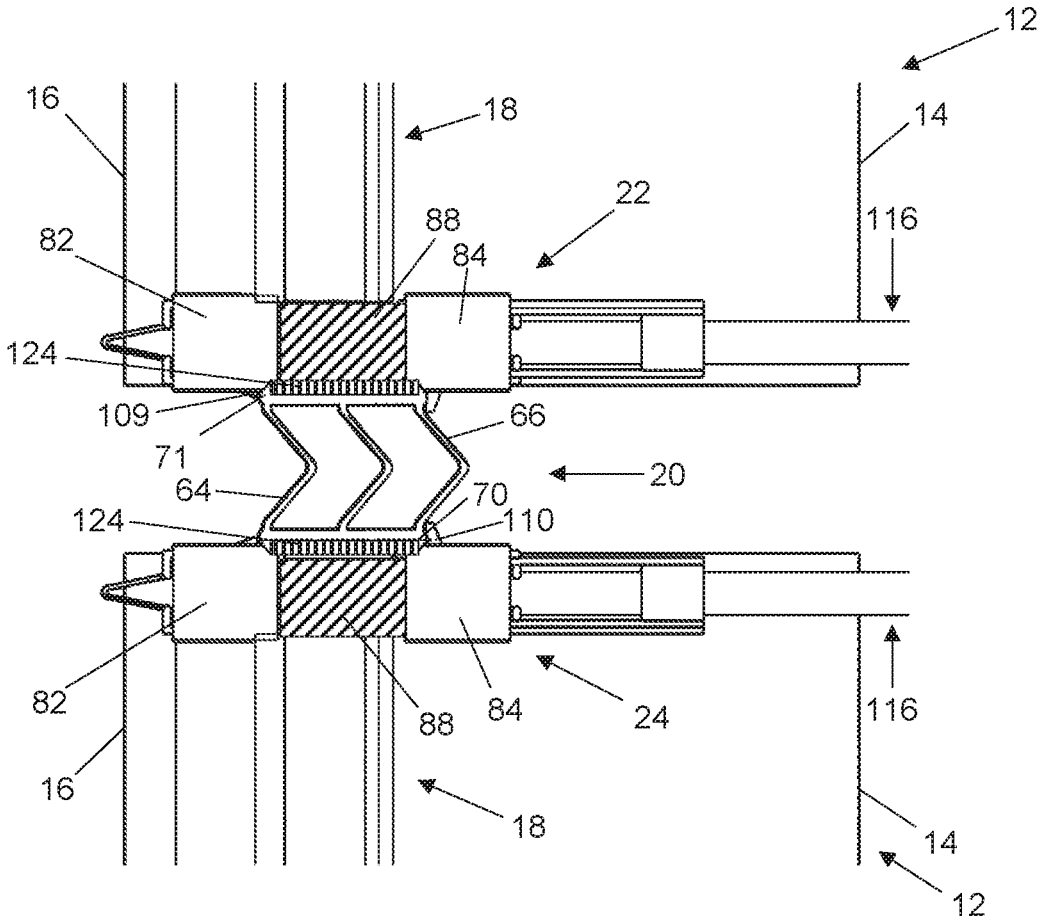
FIG. 10 is a section view of the wet sealed 4-way joint of FIG. 3.

FIG. 9 shows the horizontal seal 20 upper wet core plug 22 and lower wet core plug 24 as they would be positioned in a 4-way joint, but does not show any wall panels or vertical seals. In a 4-way joint using the wet seal system of the present disclosure, the upper wet core plug 22 is positioned on the top 62 of the horizontal seal 20 such that the sides of the caulking cavity 88 are closed by the edges of the horizontally adjacent wall panels, the front and back sides of the caulking cavity 88 are closed by the exterior stopper 82, the interior stopper 84 and the top of the caulking cavity 88 is open to the caulking cavity 30 of the vertical seal 18 and the bottom of the caulking cavity 88 which is open to the horizontal seal 24 is prefilled 124 with caulking to prevent caulking from leaking during the filling of the caulking cavities 30 and 88. The prefilled caulking is shown in detail in FIG. 10.

Figure 11:
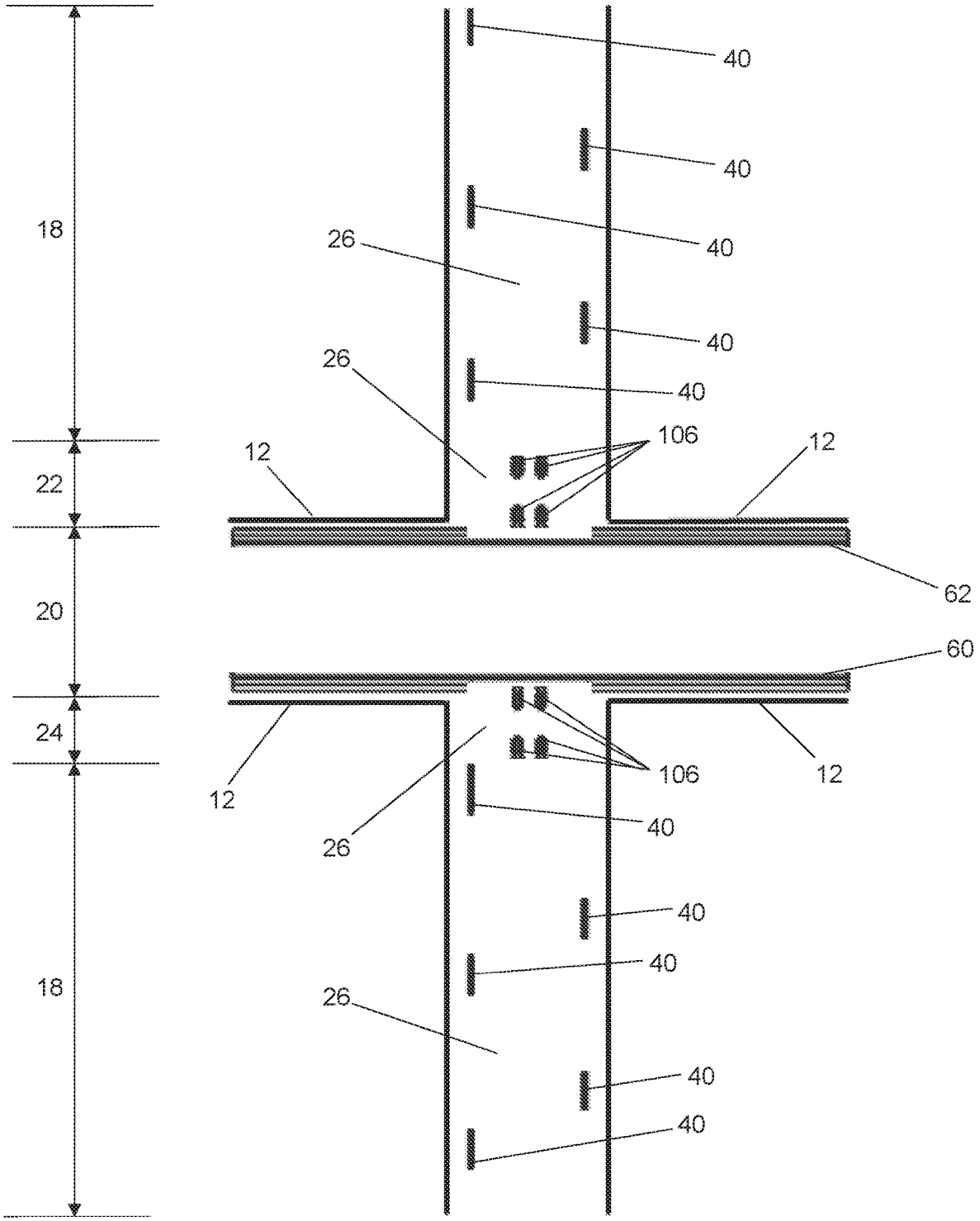
FIG. 11 is a front section view of the wet sealed 4-way joint of FIG. 3.

FIG. 11 is a section view of the 4-way joint of FIG. 3 taken along a plane parallel to the surface of the wall panels 12. It shows the 4-way joint filled with caulking 26 such that there is a continuous seal between the horizontal seal 20, upper wet core plug 22 and vertical seal 18 and between the horizontal seal 20, lower wet core plug 24 and vertical seal 18. The caulking 26 of FIG. 3 may be any suitable caulking which can bond to wall panels 12 and cure to form a seal. In a preferred embodiment, the caulking 26 is a silicone sealant.

Figure 12:
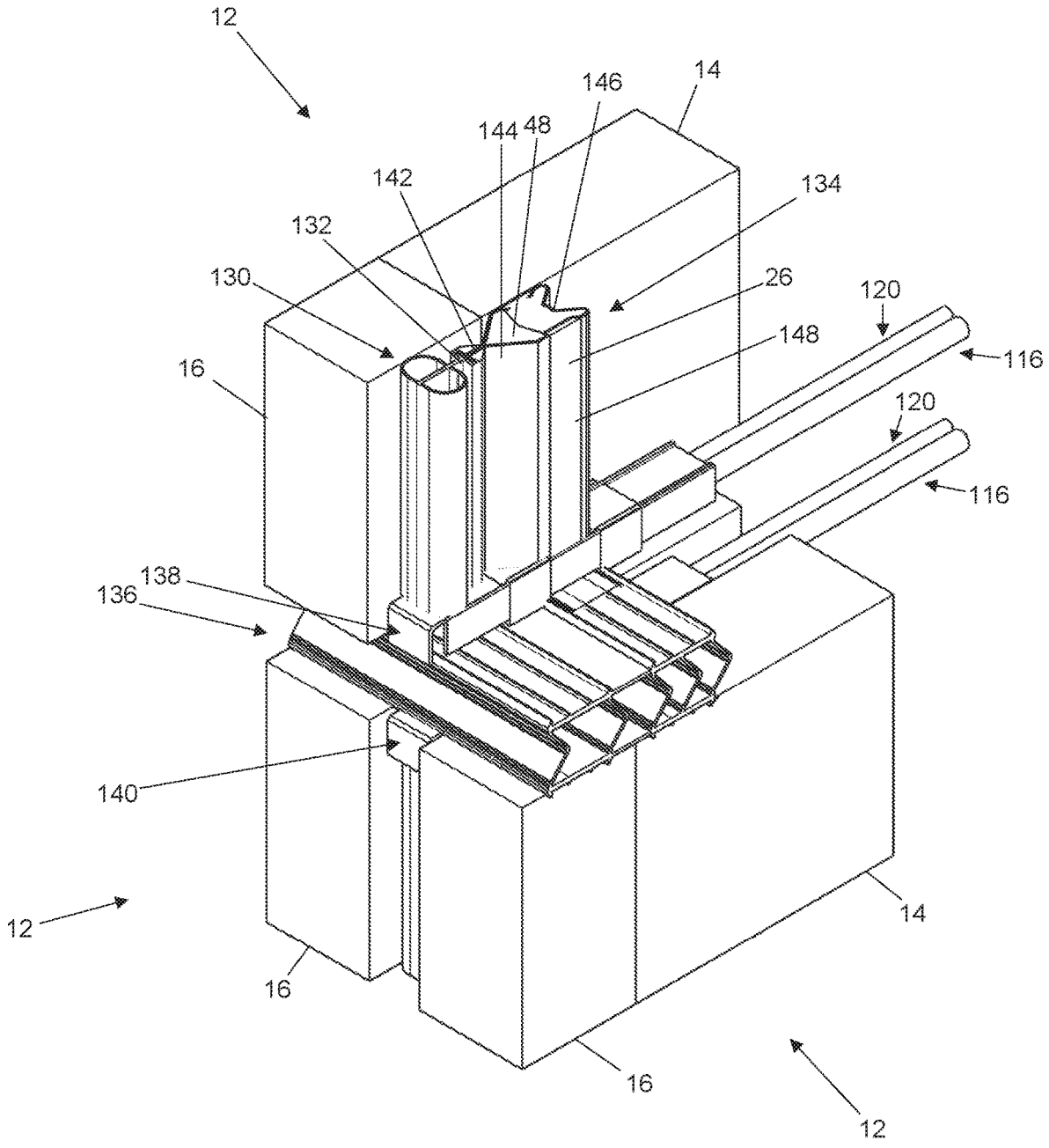
FIG. 12 is a perspective view of a wet sealed 4-way joint, sealed using an alternate embodiment of the wet seal system with two rain screens, two vertical seals, a horizontal seal and an upper wet core plug and a lower wet core plug.

In an alternative embodiment of the wet seal system shown in FIG. 12, the wet seal system further includes a rain screen 130 which is a tubular member with an external connector 132. The wet seal system with the rain screen 130 further includes a vertical seal 134, horizontal seal 136, an upper wet core plug 138 and a lower wet core plug 140. The vertical seal 134 has the same features as vertical seal 18 and further includes a rain screen connector 142 which the external connector 132 of the rain screen 130 attaches thereto. The rain screen connector 142 extends from the external side 144. The rain screen 130 is configured to be the same length as vertical seal 134. The rain screen 130 is installed with the vertical seal 134 such that the rain screen 130 is positioned between two horizontally adjacent wall panels and the can deform such that the rain screen 130 seals the gap between the two horizontally adjacent wall panels. When a force is applied to the exterior surface of the rain screen 130, the rain screen deforms and exerts a resulting force into the edges of the horizontally adjacent wall panels. This means that the seal of the rain screen 130 will improve when wind blows against the outer surface of the wall. There is a drain space 150 between the rain screen 130 and the vertical seal 134 for draining and/or venting any moisture that may pass around the rain screen 130 but is blocked by the vertical seal 134.

Figure 13:
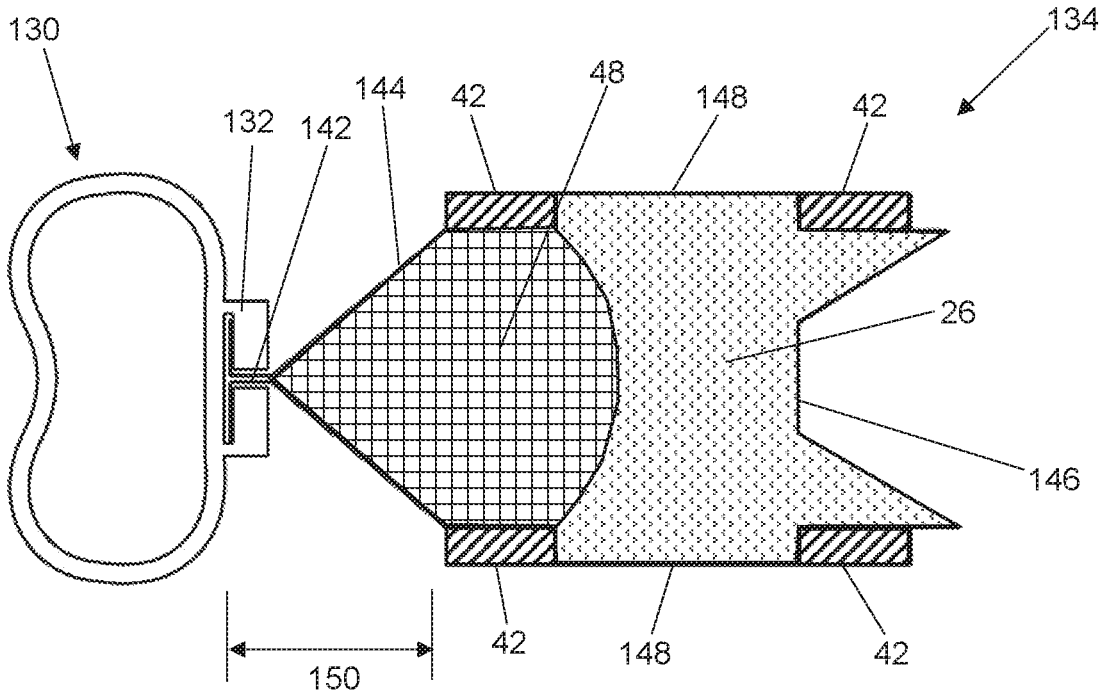
FIG. 13 is a section view of the rain screen of FIG. 12 coupled to the vertical seal of FIG. 12.

The vertical seal 134 of FIG. 12 is shown connected to the rain screen 130 in FIG. 13. In this embodiment, the external connector 132 is a female connector and the rain screen connector 142 is a male connector. The vertical seal also has an interior side 146, a pair of opposed sealing sides 148, caulking holes and web segments (not shown). FIG. 13 also shows vertical seal 134 with thermal break strips 42, an elongate foam element 48 and it is filled with caulking 26.

Figure 14:
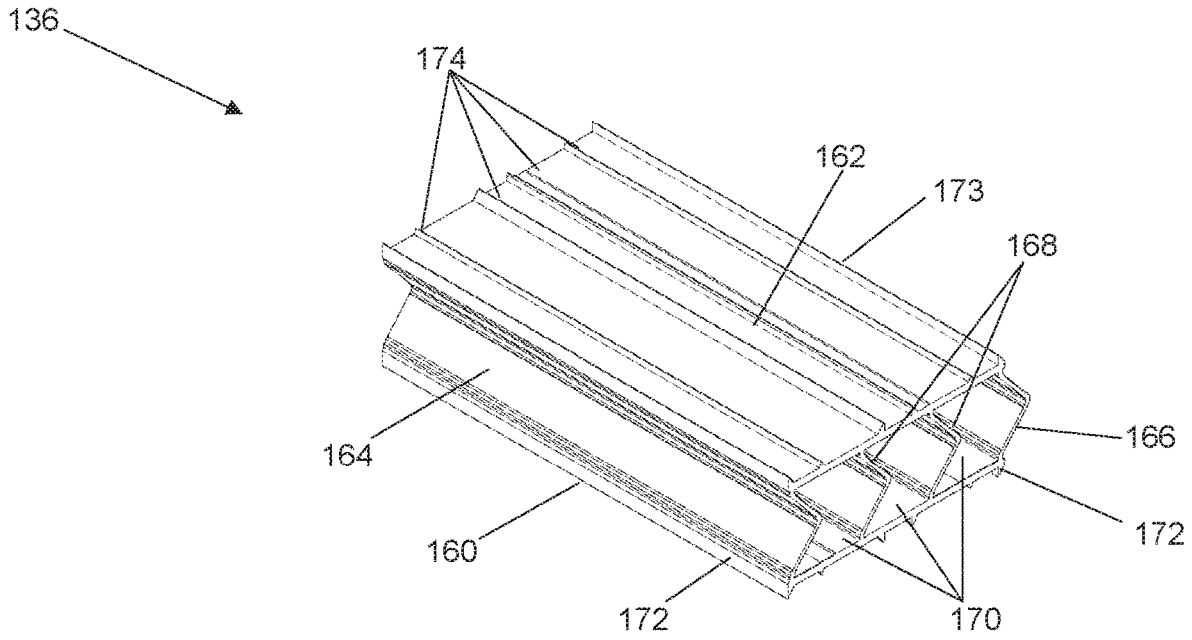
FIG. 14 is a perspective view of the horizontal seal of FIG. 12.

The horizontal seal of FIG. 12 is shown in detail in FIG. 14. The horizontal seal 136 similar to horizontal seal 20 but is extended to accommodate the increase in length of the vertical seal 134 with rain screen 130. The horizontal seal 136 is extended by having a wider base 160 and wider top 162. The extended horizontal seal 136 has an exterior wall 164, an interior wall 166 and is further supported with a greater number of chamber walls 168. For example, the embodiment of the horizontal seal 136 shown in FIG. 14 has three internal walls 168 and four chambers 170. The horizontal seal 136 also has base feet 172, upper feet 173 and ridges 174.

Figure 15:
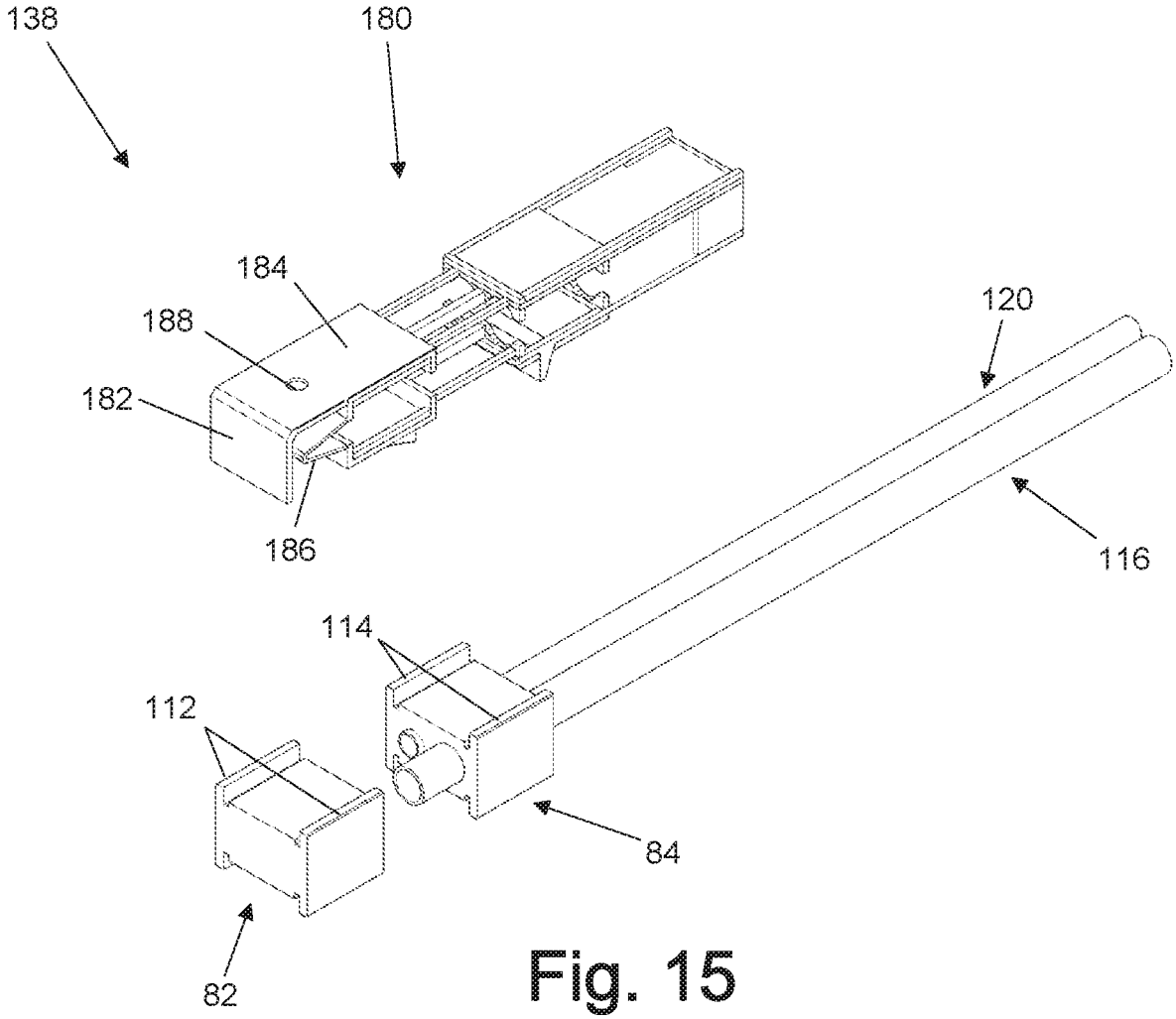
FIG. 15 is an exploded view of the upper wet core plug of FIG. 12.
Figure 16:
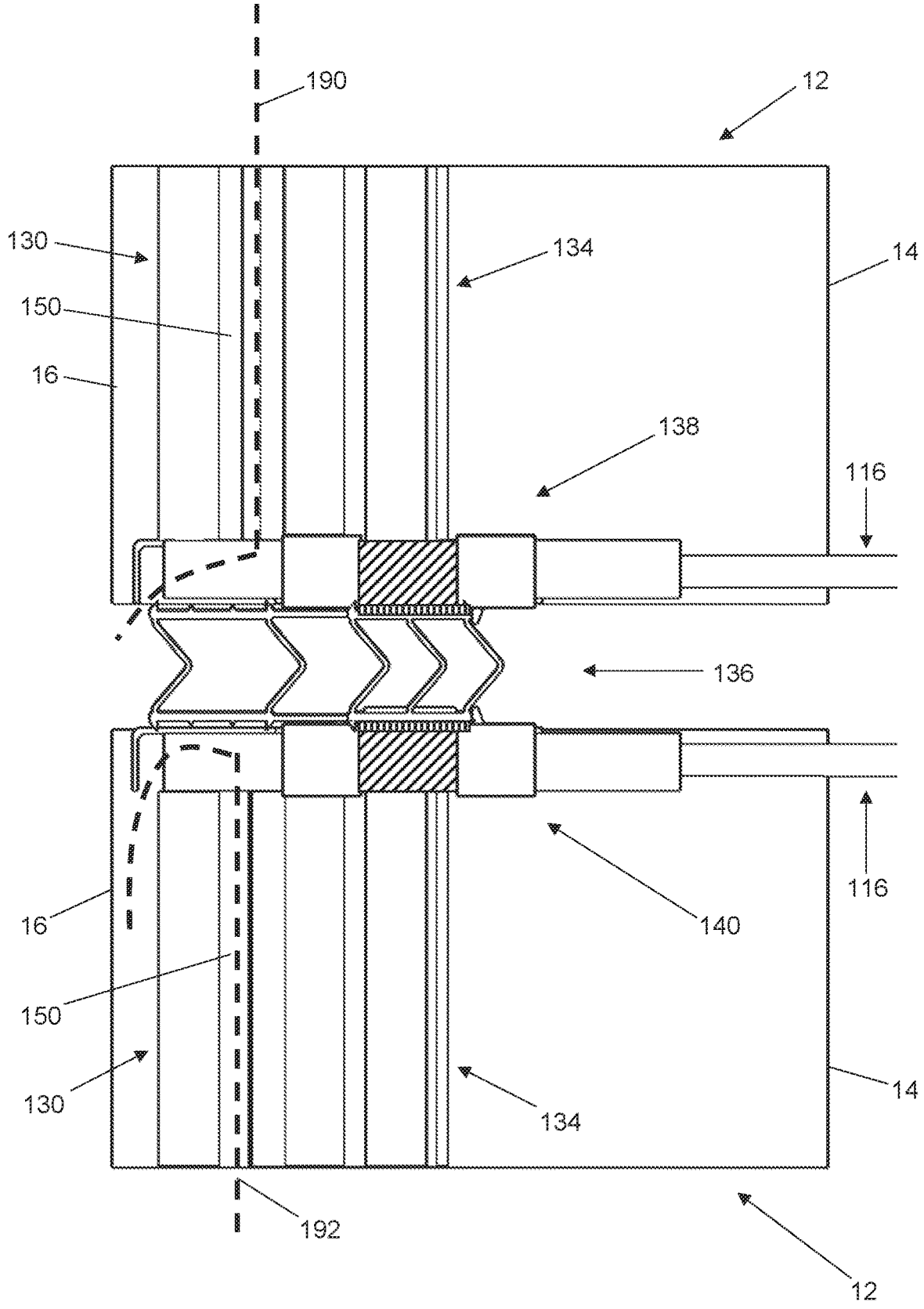
FIG. 16 is a section view of the wet sealed 4-way joint of FIG. 12.

The upper wet core plug 142 of FIG. 12 is shown in detail in FIG. 15. The lower wet core plug 140 and upper wet core plug 142 are similar to lower wet core plug 24 and upper wet core plug 22, but have slightly modified plug bases 180 which further comprise a rain barrier 182 which extends from the exterior end of the exterior stopper section 184 which is the same as external stopper end 86 of lower 24 and upper 22 wet core plugs. The rain barrier 182 extends horizontally out from the exterior stopper section 184 and curves around the hinge 186 which is the same as hinge 92. The rain barrier 182 has a drainage hole 188 positioned such that any moisture caught in the drain space 150 can drain along path 190 and is deflected off of the hinge 186, as shown in FIG. 16. Moisture is also able to escape from the top of the drain space 150 where it rises along path 192 around the bottom of hinge 186 and passes out of the bottom of the rain barrier 182. The upper wet core plug 138 and lower wet core plug 140 are compatible with the exterior stopper 82, interior stopper 84, caulking injection tube 116 and caulking inspection tube 120, as shown in FIG. 15.

Figure 17:
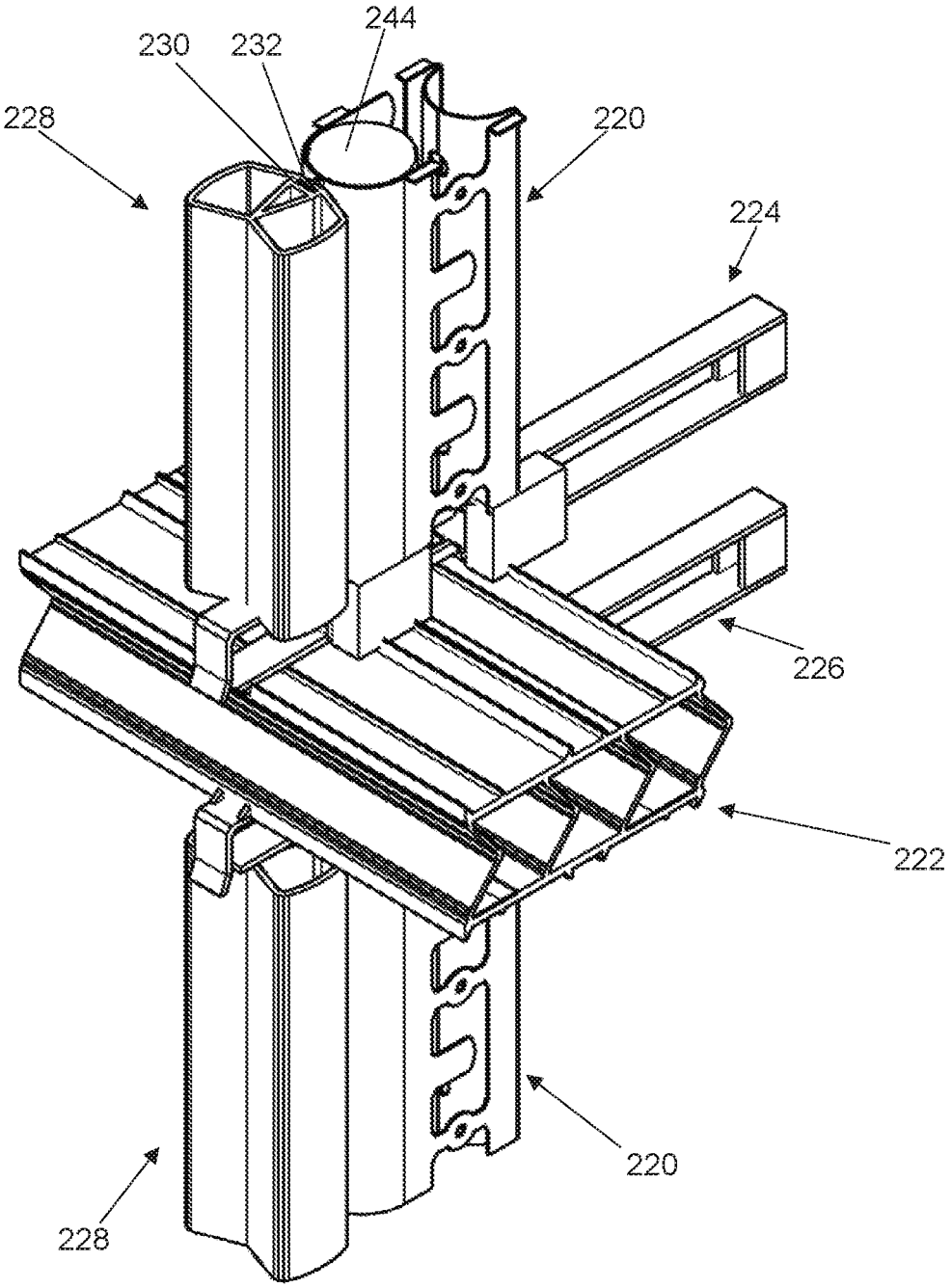
FIG. 17 is a perspective view of a wet sealed 4-way joint, sealed using an alternative embodiment of the wet seal system with two rain screens, two round vertical seals, a horizontal seal and an upper wet core plug and a lower wet core plug.

FIG. 17 shows an alternate embodiment of the wet seal system which is similar to the wet seal system shown in FIG. 12 except the vertical seal is round. Specifically, the wet seal system of FIG. 17 comprises two segments of round vertical seal 220, a segment of horizontal seal 222, an upper wet core plug 224, a lower wet core plug 226 and a rain screen 228. The horizontal seal 222 has the same features as horizontal seal 136. The upper wet core plug 224 and lower wet core plug 226 have the same features as the upper wet core plug 138 and the lower wet core plug 140 respectively. The rain screen 228 has the same function as the rain screen 130, but the rain screen 228 has internal chambers. The rain screen 228 has a connector 230 which connects to a rain screen connector 232 on the round vertical seal 220.

Figure 18:
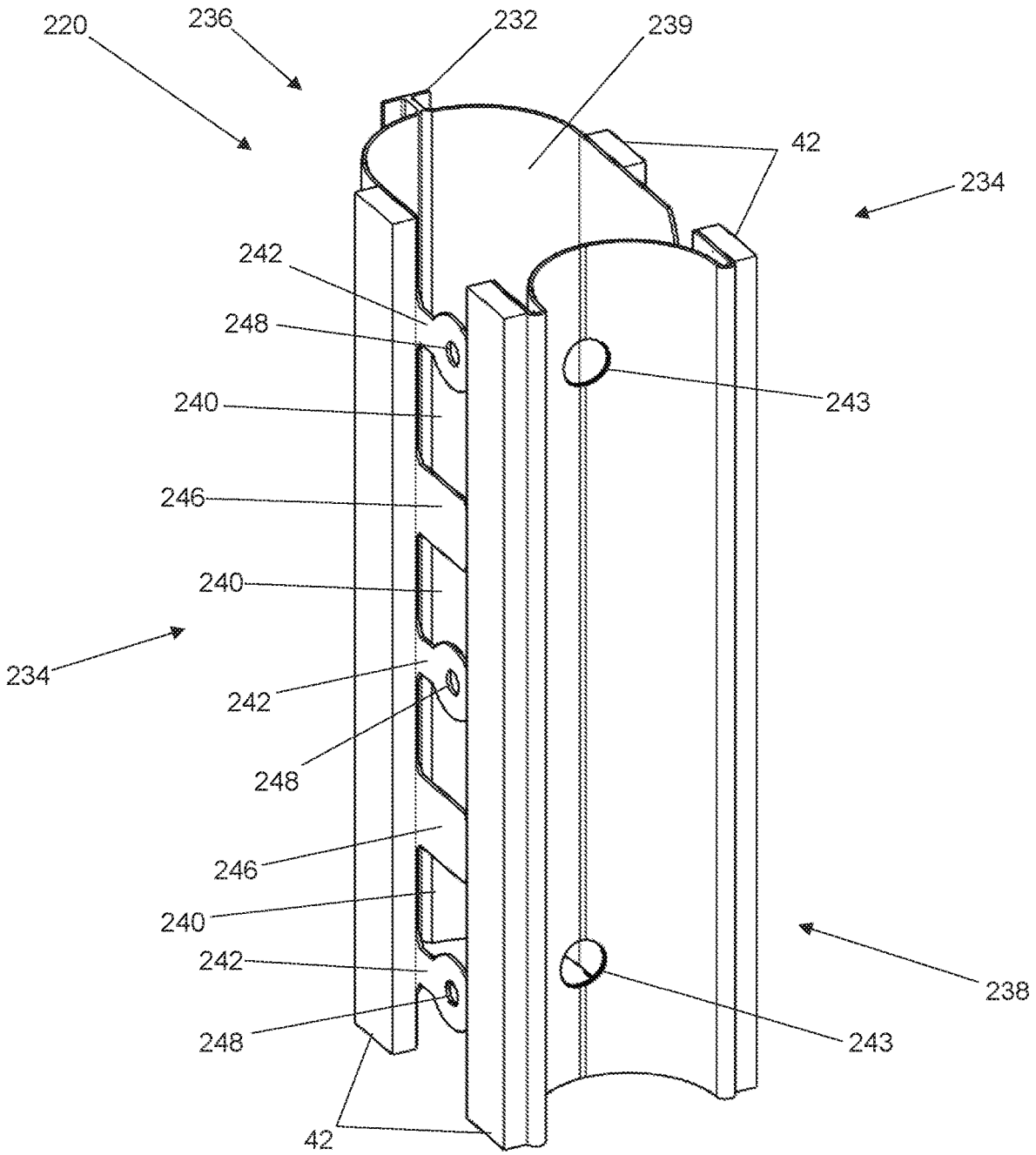
FIG. 18 is a perspective view of the round vertical seal of FIG. 17.

The round vertical seal 220 is shown in detail in FIG. 18 where the round vertical seal 220 has a pair of opposed sealing sides 234, an exterior side 236 and an interior side 238 and the space enclosed by the sides 234, 236 and 238 forms a caulking cavity 239. The round vertical seal 220 is round because the exterior side 236 and the interior side 238 are generally round. In the embodiment of FIG. 18, the exterior side 236 is convex and the interior side 238 is concave when viewed from the outside of the round vertical seal 220. The sealing sides 234 have caulking holes 240 positioned therein which are separated by web segments 242. The caulking holes 240 and web segments 242 have the same features as caulking holes 38 and web segments 40 respectively. The round vertical seal 220 also has a plurality of caulking injection holes 243. Two thermal bond strips 42 are adhered to each of the opposed sealing sides 236 where one thermal bond strip 42 is positioned on either side of the caulking holes 240.

The round vertical seal 220 has an elongate round foam elements 244 which are similar to elongate foam elements 48 except that they are cylindrical as opposed to arrow shaped. The round foam shapes 244 may be two foam shapes where one is positioned at the top of the round vertical seal 220 and one is positioned at the bottom of the round vertical seal 220. In an alternate embodiment the round foam shape 244 is a long foam cylinder which is installed such that it runs the length of the round vertical seal 220. In a preferred embodiment, the round elongate foam elements 244 is backing rod which is currently used with caulking to seal horizontally adjacent wall panels.

The round vertical seal 220 differs from the vertical seal 134 in that the round vertical seal further has elongate foam element restraining tabs 246 which are located between the web segments 242 and extend from the side of the sealing sides 234 which is proximate to the exterior side 236. The elongate foam elements restraining tabs 246 are shaped such that they can deform and prevent an air space from forming if the exterior side 236 deforms in order to decrease the width of the round vertical seal 220.

In the embodiment of the vertical seal of FIG. 18, the web segments 242 on one of the sealing sides 234 are staggered relative to the web segments of the other sealing side 234 such that one can directly access the web segments 242 on one sealing side 234 through the caulking holes 240 on the opposite sealing side 234. This enables one to fasten the segment of round vertical seal 220 to the edges of one of the exterior insulated wall panels to prevent the round vertical seal 220 from moving relative to the wall panel while the other exterior insulated wall panel is installed.

In a further embodiment of the round vertical seal, the staggered web segments 242 have fastening holes 248 such that one can position one sealing side 236 adjacent to the edge of the wall panel and insert fasteners (e.g. screws, nails, etc.) through the caulking holes 240 of the open sealing side 236 into the fastening holes 248 into the edge of the wall panel. Then one can insert a fastening device through each caulking hole 240 to fasten the fasteners from the inside of the round vertical seal 220.

The wet seal system of the present disclosure can be used to seal a 4-way joint using the following iterative method. For exemplary purposes the sealing of the 4-way joint is described in terms of the wet seal system of FIG. 3.

In order to prepare the upper 22 and lower 24 wet core plugs for use, the caulking injection tube is inserted through the caulking injection tube channel 118 and the caulking inspection tube 120 is inserted through the caulking inspection tube channel 122. Then the plug bases 80 of each plug 22 and 24 are deformed and the exterior stopper 82 is positioned within the exterior stopper section 86 and the interior stopper 84 is positioned within the interior stopper section 90.

In order to prepare the vertical seal 18 for use, the elongate foam elements 48 are inserted into the top and bottom of the vertical seal 18. Also, two strips of thermal break 42 are fixed to each sealing side 32 where one strip 42 is fixed to on each side of the caulking holes 38.

First, one positions two wall panels 12 such that they are horizontally adjacent to one another and seals the gap between the two panels. Caulking is applied to the base 60 of a segment of horizontal seal 20 and the base 60 is pressed firmly against the top edges of the two panels 12 such that the horizontal seal at least runs along the combined length of two wall panels 12 and the exterior wall 64 faces the exterior of the wall panels 12. Next caulking is applied to the top 62 of the horizontal seal 20 and one wall panel 12 is positioned on top of the horizontal seal 20 such that the caulking on the top 62 bonds and cures to the bottom edge of the wall panel 12.

Then caulking is applied to the top 62 at the location beside the vertical edge of the wall panel 12 which is being sealed such that caulking pre-fills up to the feet 70 and 71 of the top 62, shown in FIG. 9. Then an upper wet core plug is placed on the horizontal seal 20 such that the exterior locator stub 109 is in contact with the feet 70 and 71 proximate to the exterior wall 64 of the horizontal seal 20 and the interior locator stub 110 is in contact with the feet 70 proximate to the interior wall 66 of the horizontal seal 20, its side is in contact with the edge of the wall panel 12, its exterior stopper section 86 faces the exterior of the wall panels 12, and the bottom of the caulking cavity 88 is in the pre-filled caulking.

Then, a segment of vertical seal 18 is positioned along the vertical edge of the wall panel 12 such that one the thermal break strips 42 on one of the sealing sides 32 is in contact with the edge of the wall panel 12, its exterior side faces the exterior of the wall panels 12, its bottom is in direct contact with the top of the exterior stopper section 86, caulking cavity 88 and interior stopper section 90 of the upper wet core plug 22 and the caulking cavity 30 is generally overlapping the caulking cavity 88. The fasteners are inserted through the caulking holes 38 on the open side of the vertical seal 18 into the fastening holes 46 in the web segments 40. The fasteners are tightened through the caulking holes 38 such that the fasteners pass into the wall panel 12 and fix the vertical seal 18 to the edge of the wall panel 12.

Then a lower wet core stopper 24 is placed on top of the top opening of the vertical seal 18 such that the bottom of the caulking cavity 88 generally overlaps the caulking cavity 30 and the exterior stopper section 86 faces the exterior of the wall panels 12.

Then a wall panel 12 is positioned on top of the horizontal seal 20 such that it is horizontally adjacent to the wall panel 12 and is in contact with the thermal break strips 42 of the other sealing side 32. If the gap between the two wall panels 12 is smaller than the width of the exterior stopper 82 and the interior stopper 84 of the upper wet core plug 22. Then the lateral sealing section 112 of the exterior stopper 82 and the lateral sealing section 114 of the interior stopper 84 will compress to decrease the width of the upper wet core plug 22. If the gap between the panels is smaller than the width of the vertical seal 18 then the exterior side 34 and interior side 36 will deform and decrease the width 50 of the vertical seal 18 as shown in FIG. 5A and FIG. 5B. If the gap between the two wall panels 12 is smaller than the width of the exterior stopper 82 and the interior stopper 84 of the lower wet core plug 24. Then the lateral sealing section 112 of the exterior stopper 82 and the lateral sealing section 114 of the interior stopper 84 will compress to decrease the width of the lower wet core plug 24. This configuration forms a continuous caulking mould comprising the caulking cavity 88 of the upper wet core plug 22, the caulking cavity 30 and each sealing space 44 of the vertical seal 18, and the caulking cavity 88 of the lower wet core plug 24. The vertical seal 18 is configured such that its length when combined with the heights of the upper wet core plug 22 and the lower wet core plug 24 is equivalent to the height of a wall panel 12.

Then caulking 26 is injected into the caulking injection tube 116 of the upper wet core plug 22 such that the caulking cavity 88 fills with caulking and the caulking flows through the sides of the caulking cavity 88 and bonds to the edges of the panels 12. The caulking is prevented from flowing out through the bottom of the caulking cavity 88 by the pre-filled portion of the horizontal seal 20. When caulking begins flowing out of the caulking inspection tube 120 caulking 26 ceases being injected through the caulking injection tube 50. Then caulking 26 is injected into the caulking cavity 30 of the caulking injection hole 52 of the vertical seal 18 closest to the upper wet core plug 22 and the caulking 26 flows through the caulking holes 38 and fills both of the seal spaces 44. When caulking 26 begins flowing out of the caulking inspection hole 54 the caulker ceases injecting caulking 26 through the caulking injection hole 52. Then this process is repeated through each of the caulking injection holes 52. Then caulking 26 is injected into the caulking injection tube 116 of the lower wet core plug 24 such that the caulking cavity 88 fills with caulking and the caulking flows through the sides of the caulking cavity 88 and bonds to the edges of the panels 12. When caulking begins flowing out of the caulking inspection tube 120 caulking 26 ceases being injected through the caulking injection tube 50. Some caulking 26 will overflow out of the top of the caulking cavity 88. The horizontally adjacent wall panels 12 are continuously sealed after the caulking injection process because the caulking cavity 30 is open to the top of the caulking cavity 88 of the upper wet core plug 22 and the bottom of the caulking cavity 88 of the lower wet core plug 24. One of ordinary skill in the art will appreciate that the caulking cavities 30 and 88 may be completely filled using only the caulking injection hole 52 or one of the caulking injection tubes 116.

Next caulking is applied to the base 60 of a second segment of horizontal seal 20 which has a length that is at least the combined length of the two horizontally adjacent wall panels 12. The second segment of horizontal seal 20 is pressed firmly against the top edge of the wall panels such that its exterior wall 64 faces the exterior of the wall panels 12 and its feet 70 and 71 align with the exterior locator stub 109 and the interior locator stub 110 on the top of the lower wet core plug 24.

During this process, the caulking 26 cures to seal the joints between the wall panels 12. The process can be repeated as many times as necessary for additional joints.

It will be appreciated by those skilled in the art that the wet seal system described therein could also be used in 3-way joints, as shown in FIG. 2A, wherein the vertical joints are offset such that three panels 12 are joined together. It is similar to the joints described herein but that the sides of the vertically adjacent panels 12 are not aligned.

The wet seal system of the present disclosure can form seals between adjacent wall panels which are separated by a distance greater than 1.5" and the seals comply with the ATSM E330 standard.

In order to overcome the limitations that come with the horizontal seal 20 having a finite length, the horizontal seal 20 is configured to be spliced easily on site to join two segments of horizontal seal 20 in a straight line or at an angle. FIGS. 15A-D shows two segments of horizontal seal 20 spliced according to the following method.

Figure 19A:
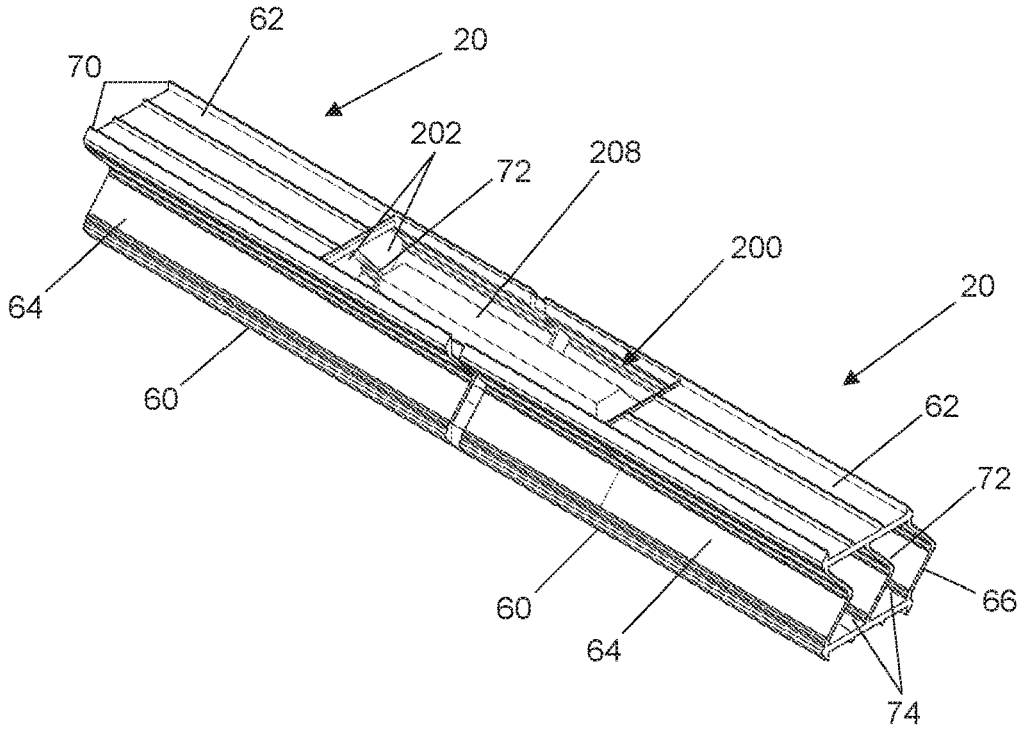
FIG. 19A is a perspective view of two horizontal seals of FIG. 3 being spliced along a straight line.
Figure 19B:
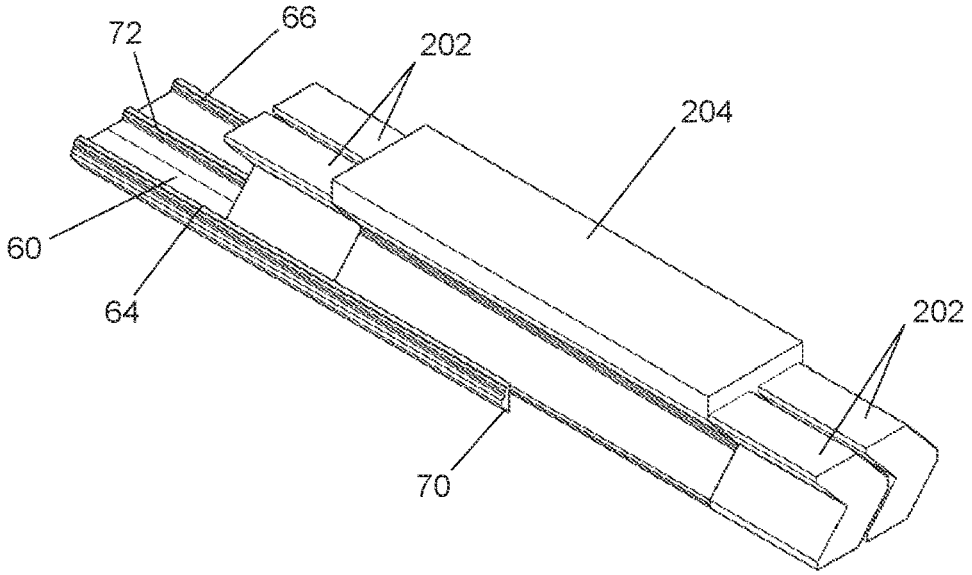
FIG. 19B is a partial view of the splice of FIG. 19A.
Figure 19C:
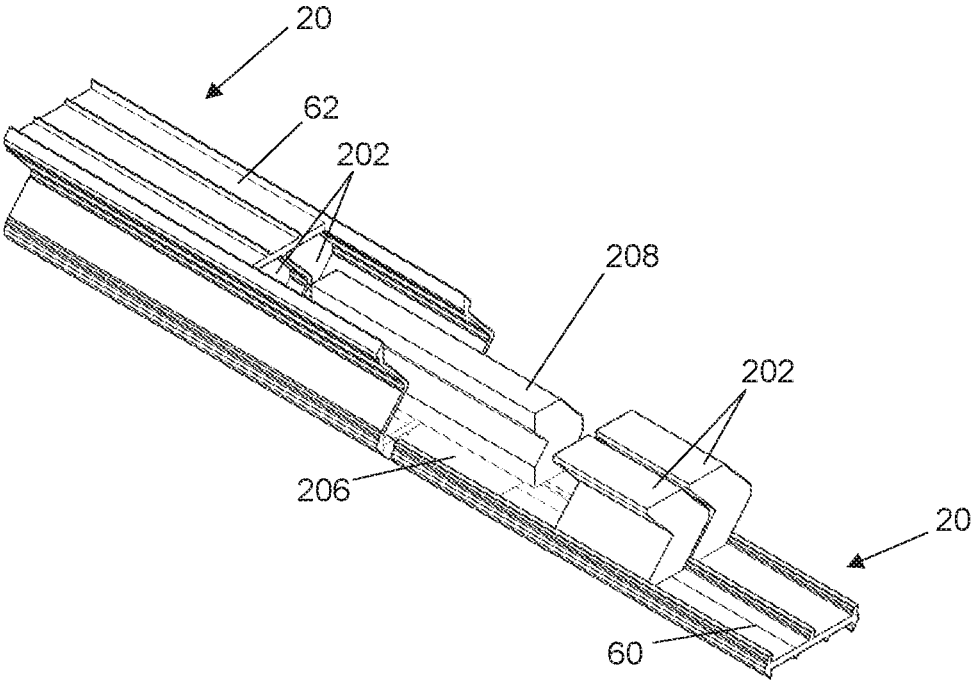
FIG. 19C is a partial view of the splice of FIG. 19A.
Figure 19D:
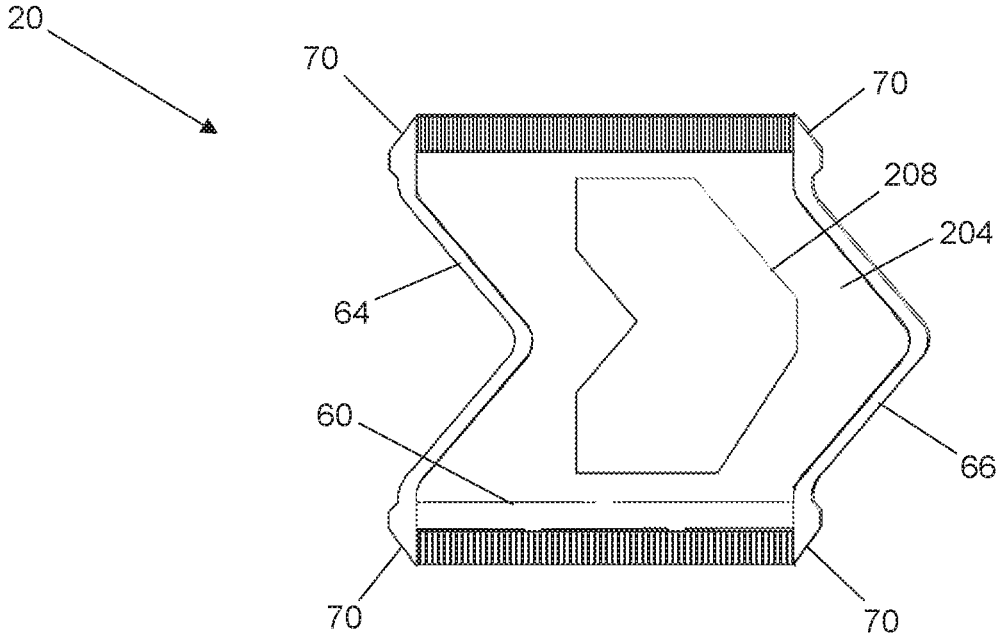
FIG. 19D is a section view of the splice of FIG. 19A after completion.
Figure 19E:
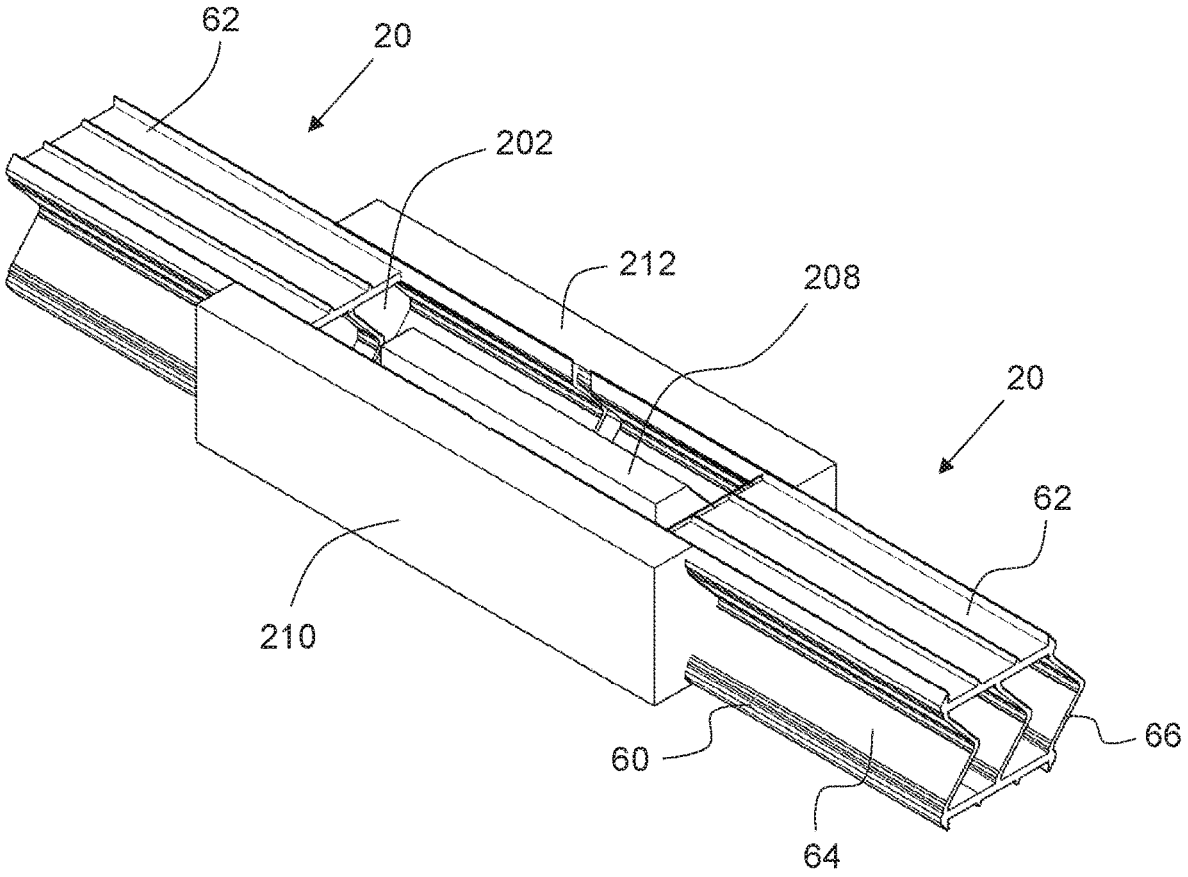
FIG. 19E a perspective view of two horizontal seals similar to that shown in FIG. 19A but also including an exterior formation block and an interior formation block.

The two segments of horizontal seal 20 are fixed to the top of a wall panel by extruding caulking along the feet 70 and 71 of the base 60 and the bases 60 of each segment 20 are pressed against the wall panel edge such that there is a gap between the two horizontal seals 20. In a preferred embodiment, the gap is ¼". Then the top 62 of each adjacent horizontal seal 20 is cut and removed such that there is an opening into the chambers 74 and the chamber wall 72 which separates the chambers 74 is also removed to form a splice cavity 200. The splice cavity 200 is sealed from the chambers 74 by inserting horizontal seal stoppers 202 into the chambers 74 at the position where the splice cavity 200 starts. The horizontal seal stoppers 202 allow the splice cavity 200 to be filled with caulking without the caulking 204 from filling the rest of the horizontal seal 24 as shown in FIG. 19B. Then an exterior formation block 210 is positioned such that it contours and spans the exterior walls 64 of the splice cavity 200 and an interior formation block 212 is positioned such that it contours and spans the interior walls 66 of the splice cavity 200 as shown in FIG. 19E. Then a bottom portion of the splice cavity 200 is filled with a caulking layer 206 as shown in FIG. 19C. Then a splice core 208 is placed within the splice cavity 200 on top of the caulking layer 206. The splice core 208 provides support to the spliced joint. Then the splice cavity 200 is filled up to the top 62 with caulking 204 as shown in FIG. 19D. After the caulking cavity 200 is filled with caulking 204 and the caulking 204 has cured, the exterior formation block 210 and the interior formation block 212 are removed. The exterior and interior formation blocks 210, 212 enable caulking 204 to fill the gap between the horizontal seals 20.

In a further embodiment of the method for splicing horizontal seals 20, a segment of dual-sided foam tape is fixed to the top of the wall panel before the horizontal seals 20 are attached. Then caulking is extruded to the interior side of the dual-sided foam tape such that the height of the caulking is slightly higher than that of the dual-sided foam tape. The film protecting the adhesive on the opposite side of the dual-sided foam tape is removed and each segment of horizontal seal 20 is positioned such that the feet 70 and 71 proximate to the exterior wall 64 are in contact with the edge of the dual-sided foam tape. The dual-sided foam tape provides an additional seal between the horizontal seal 20 and the wall panel, helps to align the segments of horizontal seal 20 and fixes the segments of horizontal seal 20 in position while the caulking is curing.

Figure 20A:
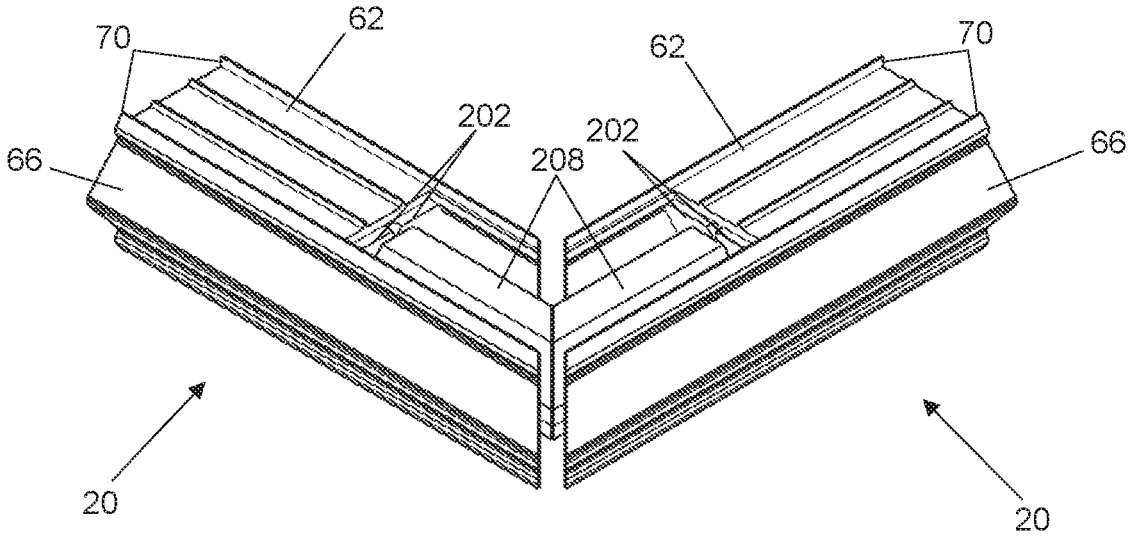
FIG. 20A is a perspective view of two horizontal seals of FIG. 3 being spliced at an angle where the interior wall faces the outside of the bend.
Figure 20B:
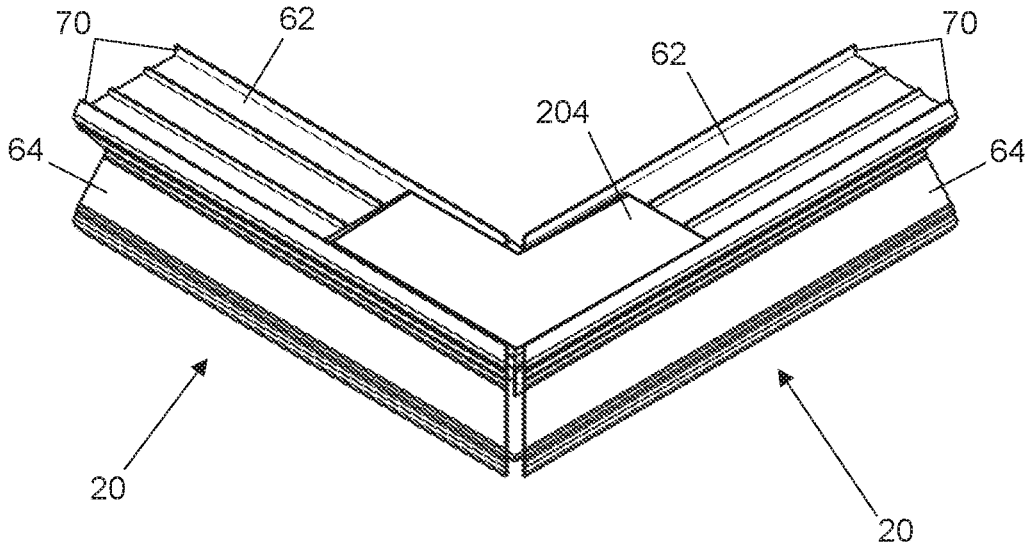
FIG. 20B is a perspective view of two horizontal seals of FIG. 3 spliced at an angle where the interior wall faces the inside of the bend.

One of ordinary skill in the art will appreciate that the above-mentioned splicing method is suitable with straight and angled splices. For example, FIG. 20A and FIG. 20B show the splice method being used to splice two segments of horizontal seal 24 at a right angle. In this embodiment splice core 208 includes two sections in a right angle configuration with each other.

Figure 21A:
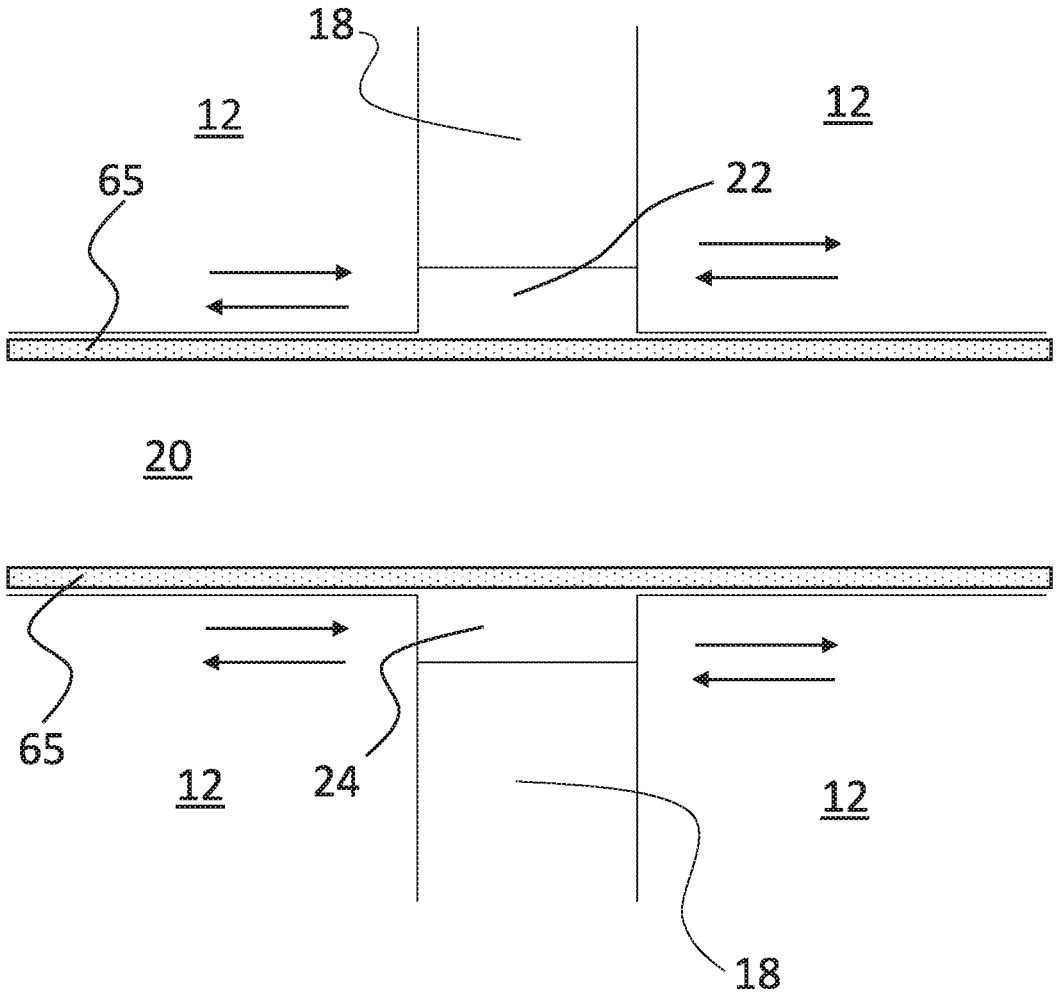
FIG. 21A is a section view of a wet sealed 4-way joint.
Figure 21B:
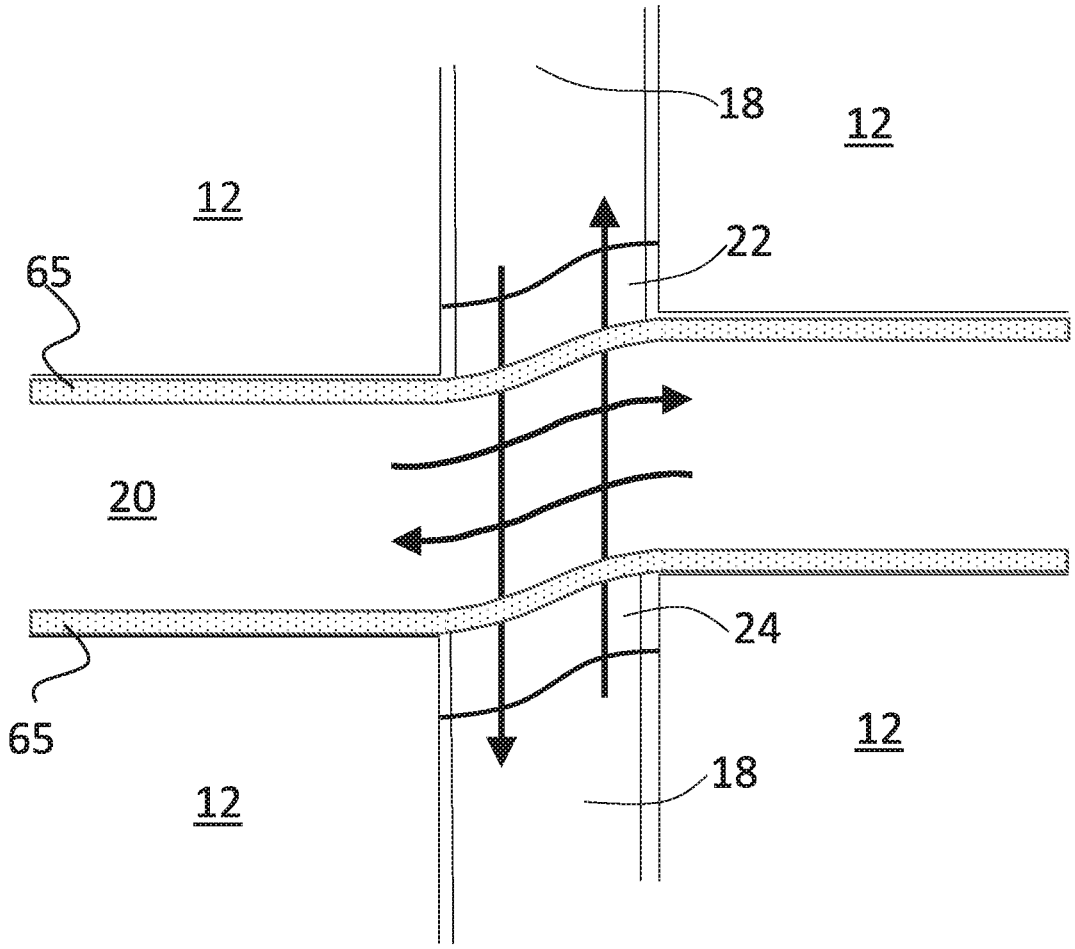
FIG. 21B is a section view of a wet sealed 4-way joint of FIG. 21A after deflection.
Figure 22A:
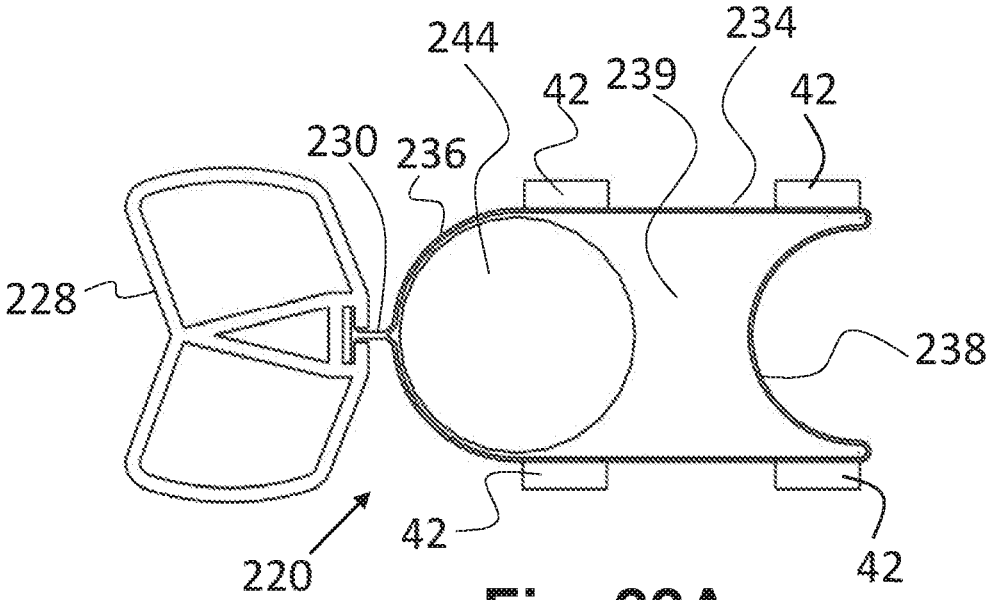
FIG. 22A is a section view of the round vertical seal of FIG. 18.
Figure 22B:
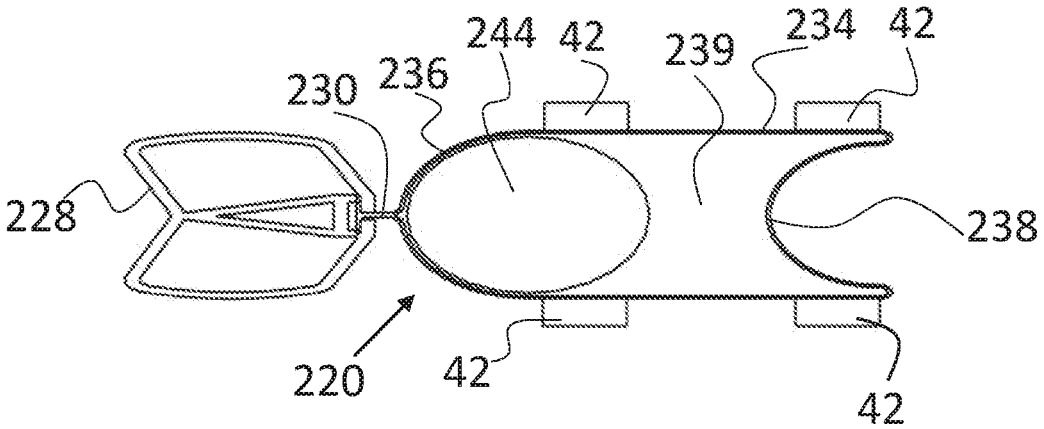
FIG. 22B is a section view of the round vertical seal of FIG. 18 similar to that shown in FIG. 22A but after notional adjacent exterior panels that are on either side of the seal have moved closer together.

It will be appreciated by those skilled in the art that there are a number of advantages realized by the embodiments shown and described herein. For example it will be appreciated that the wet seal system may be compliant with large construction tolerances with regard to the spacing and orientation of wall panels relative to each other. More specifically this can be seen in reference to FIGS. 21A, 21B, 22A and 22B. As is shown in FIG. 21A the wet seal system can accommodate horizontal movement that may be caused by shear created by panel temperature movements and is shown in by the arrows. Similarly, the wet seal system can accommodate movement caused by seismic and wind loads as shown in FIG. 21B with the arrows. Seismic and wind loads cause a building to sway which can cause exterior wall panels to rotate or rack relative to each other. Vertical shear created by building movements that rack the wall panels are accommodated by flexure of the horizontal seal 20. FIGS. 22A and 22B show more specifically how the vertical seal can accommodate construction and manufacture tolerances. Whereby the exterior side 236 and the interior side 238 deflect such that the sides 234 move relative to each other. Similarly the rain shield 130 will deform under a load. As well the vertical seal may be installed from the inside of a building. Further, the wet seal system may be easy and quick to inspect to ensure that the seals are properly installed.

What is claimed as the invention is:

1. A method for splicing two horizontal seals comprising the steps of:

positioning a first horizontal seal such that an end of the first horizontal seal is adjacent to an end of a second horizontal seal and there is a gap between the end of the first horizontal seal and the end of the second horizontal seal;

defining a splice cavity between the first horizontal seal and the second horizontal seal;

inserting horizontal seal stoppers into the first horizontal seal and inserting horizontal seal stoppers into the second horizontal seal such that the caulking cannot flow from the splice cavity through the first horizontal seal or the second horizontal seal;

positioning an exterior formation block in contact with an exterior wall of the first horizontal seal and an exterior wall of the second horizontal seal, and further positioning an interior formation block in contact with an interior wall of the first horizontal seal and an interior wall of the second horizontal seal such that caulking cannot flow through the gap between the first horizontal seal and the second horizontal seal;

applying a volume of caulking to a bottom of the splice cavity such that the volume of caulking forms a caulking layer;

placing a splice core on top of the caulking layer;

filling the splice cavity with caulking such that a continuous volume of caulking is formed from the bottom of the splice cavity to a top of the first horizontal seal and a top of the second horizontal seal; and removing the exterior formation block and the interior formation block.

2. The method for splicing two horizontal seals of claim 1, wherein a segment of dual-sided foam tape is fixed to a surface prior to the positioning a first horizontal seal step such that the dual-sided foam tape can fix the first horizontal seal and the second horizontal seal to the surface and align the first horizontal seal and the second horizontal seal.

3. The method for splicing two horizontal seals of claim 2, wherein the gap between the first horizontal seal and the second horizontal seal is ¼".

4. The method for splicing two horizontal seals of claim 1 further including the step of cutting a section of the top of the first horizontal seal and cutting a section of the top of the second horizontal seal such that the sections are adjacent and to form the splice cavity.

5. The method for splicing two horizontal seals of claim 1 wherein the first horizontal seal is generally perpendicular to the second horizontal seal.

6. The method for splicing two horizontal seals of claim 5 wherein the splice core includes two sections in a right angle configuration with each other.

* * * * *